US009797610B2

(12) United States Patent
Yamashita et al.

(10) Patent No.: US 9,797,610 B2
(45) Date of Patent: Oct. 24, 2017

(54) AIR-CONDITIONING APPARATUS WITH REGULATION OF INJECTION FLOW RATE

(75) Inventors: Koji Yamashita, Tokyo (JP); Takeshi Hatomura, Tokyo (JP); Katsuhiro Ishimura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 790 days.

(21) Appl. No.: 14/238,541

(22) PCT Filed: Nov. 7, 2011

(86) PCT No.: PCT/JP2011/006194
§ 371 (c)(1),
(2), (4) Date: Feb. 12, 2014

(87) PCT Pub. No.: WO2013/069044
PCT Pub. Date: May 16, 2013

(65) Prior Publication Data

US 2014/0182329 A1 Jul. 3, 2014

(51) Int. Cl.
*F25B 41/04* (2006.01)
*F24F 5/00* (2006.01)
(Continued)

(52) U.S. Cl.
CPC ..... *F24F 5/001* (2013.01); *F25B 13/00* (2013.01); *F25B 31/008* (2013.01); *F25B 41/04* (2013.01); *F25B 25/005* (2013.01); *F25B 2313/003* (2013.01); *F25B 2313/0231* (2013.01); *F25B 2313/02732* (2013.01); *F25B 2313/02741* (2013.01); *F25B 2313/0312* (2013.01); *F25B 2313/0314* (2013.01); *F25B 2313/0315* (2013.01); *F25B 2500/19* (2013.01);
(Continued)

(58) Field of Classification Search
CPC ..... F24F 5/001; F25B 13/00; F25B 31/008; F25B 41/04
USPC ..... 62/205
See application file for complete search history.

(56) References Cited

U.S. PATENT DOCUMENTS 4,262,492 A 4/1981 Morita et al.
4,802,338 A * 2/1989 Oswalt ..... F25B 41/04 62/196.4
(Continued)

FOREIGN PATENT DOCUMENTS

CN 101793420 A 8/2010
CN 102483273 A 5/2012
(Continued)

OTHER PUBLICATIONS

Extended European Search Report dated Jun. 9, 2015 in the corresponding EP application No. 11875383.9.
(Continued)

*Primary Examiner* — Ljiljana Ciric
(74) *Attorney, Agent, or Firm* — Posz Law Group, PLC

(57) ABSTRACT

An air-conditioning apparatus includes a suction-injection pipe that introduces a refrigerant in a liquid or two-phase state into a suction side of a compressor, an expansion device that is arranged at the suction-injection pipe, and a controller that regulates the suction-injection flow rate of a refrigerant introduced into the suction side of the compressor through the suction-injection pipe by controlling the opening degree of the expansion device.

18 Claims, 13 Drawing Sheets

(51) Int. Cl.
*F25B 13/00* (2006.01)
*F25B 31/00* (2006.01)
*F25B 25/00* (2006.01)

(52) U.S. Cl.
CPC ... *F25B 2500/26* (2013.01); *F25B 2600/2513* (2013.01); *F25B 2700/1931* (2013.01); *F25B 2700/1933* (2013.01); *F25B 2700/21151* (2013.01); *F25B 2700/21152* (2013.01); *F25B 2700/21161* (2013.01); *F25B 2700/21162* (2013.01); *F25B 2700/21163* (2013.01); *F25B 2700/21173* (2013.01); *F25B 2700/21174* (2013.01); *F25B 2700/21175* (2013.01)

(56) References Cited

U.S. PATENT DOCUMENTS 4,850,201 A * 7/1989 Oswalt ..... F25B 41/04 62/185
4,959,971 A * 10/1990 Minari ..... F25B 31/008 62/138
6,343,482 B1 * 2/2002 Endo ..... F25B 13/00 62/160
8,549,868 B2 * 10/2013 Komori ..... F24D 3/08 62/113
8,733,118 B2 * 5/2014 Ushijima ..... F25B 30/02 62/159
8,899,058 B2 * 12/2014 Unezaki ..... F25B 13/00 62/113
9,279,608 B2 * 3/2016 Wakamoto ..... F25B 1/10
2001/0029747 A1 * 10/2001 Gaul ..... F04B 39/066 62/498
2003/0094007 A1 * 5/2003 Choi ..... F25B 1/053 62/197
2004/0159111 A1 * 8/2004 Takegami ..... F25B 13/00 62/84
2004/0237578 A1 * 12/2004 Takegami ..... F25B 49/02 62/510
2005/0217292 A1 10/2005 Onishi et al.
2006/0032623 A1 * 2/2006 Tsubone ..... B60H 1/00492 165/202
2006/0080989 A1 * 4/2006 Aoki ..... F25B 40/00 62/324.4
2008/0098760 A1 * 5/2008 Seefeldt ..... F25B 1/10 62/238.7
2008/0229769 A1 * 9/2008 Takegami ..... F25B 13/00 62/175
2009/0077985 A1 * 3/2009 Takegami ..... F25B 13/00 62/175
2010/0043467 A1 * 2/2010 Kawano ..... F25B 13/00 62/129
2010/0175400 A1 * 7/2010 Kasahara ..... F25B 1/10 62/225
2010/0193155 A1 8/2010 Nakatani et al.
2011/0036119 A1 * 2/2011 Fujimoto ..... F25B 1/10 62/510
2011/0061413 A1 * 3/2011 Setoguchi ..... F24F 3/065 62/238.7
2011/0174005 A1 * 7/2011 Takegami ..... F25B 1/10 62/228.1
2012/0118530 A1 5/2012 Yamashita et al.

FOREIGN PATENT DOCUMENTS

EP 2224191 A2 9/2010
EP 2312226 A2 4/2011
JP 54-069859 A 6/1979
JP 61-114058 A 5/1986
JP 02-110255 A 4/1990
JP 05-256525 A 10/1993
JP 07-151413 A 6/1995
JP 2001-311573 A 11/2001
JP 2002-213841 A 7/2002
JP 2005-282972 A 10/2005
JP 2008-157550 A 7/2008
JP 2010-197033 A 9/2010
JP 2011-052883 A 3/2011
JP 2011-112327 A 6/2011
JP 2011-158177 A 8/2011
WO 2010/049998 A1 5/2010
WO 2011/030407 A1 3/2011

OTHER PUBLICATIONS

International Search Report of the International Searching Authority dated Jan. 24, 2012 for the corresponding international application No. PCT/JP2011/006194.
Office Action dated Feb. 10, 2015 issued in corresponding JP patent application No. 2013-542678 (and English translation).
Office Action dated May 27, 2015 in the corresponding CN application No. 201180074701.4 ( English translation attached).
Office Action dated Nov. 4, 2014 issued in corresponding JP patent application No. 2013-542678 (and English translation).

* cited by examiner

AIR-CONDITIONING APPARATUS WITH REGULATION OF INJECTION FLOW RATE

CROSS REFERENCE TO RELATED APPLICATION

This application is a U.S. national stage application of PCT/JP2011/006194 filed on Nov. 7, 2011, the contents of which are incorporated herein by reference.

TECHNICAL FIELD

The present invention relates to air-conditioning apparatuses applied to, for example, multi-air-conditioning apparatuses for buildings.

BACKGROUND ART

As an air-conditioning apparatus, such as a multi-air-conditioning apparatus for a building, an air-conditioning apparatus has existed which implements a cooling and heating mixed operation by causing a refrigerant to circulate from an outdoor unit to a relay unit and causing a heat medium, such as water, to circulate from the relay unit to an indoor unit so that the conveyance power of the heat medium is reduced while the heat medium, such as water, is circulating in the indoor unit (see, for example, Patent Literature 1).

Furthermore, a circuit which injects liquid into the middle of a compressor from a high-pressure liquid pipe in a refrigeration cycle in order to reduce the discharge temperature of the compressor and an air-conditioning apparatus which is capable of controlling the discharge temperature to a set temperature, regardless of the operating state, have existed (see, for example, Patent Literature 2).

Furthermore, an air-conditioning apparatus exists which is capable of injecting a liquid refrigerant in a high-pressure state in a refrigeration cycle into a suction side of a compressor either in a cooling operation or a heating operation (see, for example Patent Literature 3).

PATENT LITERATURE

Patent Literature 1: WO10/049,998 (Page 3, FIG. 1 etc.)

Patent Literature 2: Japanese Unexamined Patent Application Publication No. 2005-282972 (Page 4, FIG. 1 etc.)

Patent Literature 3: Japanese Unexamined Patent Application Publication No. 2-110255 (Page 3, FIG. 1 etc.)

In the air-conditioning apparatus, such as a multi-air-conditioning apparatus for a building, described in Patent Literature 1, there is no problem if R410A or the like is used as a refrigerant. However, in the case where R32 or the like is used as a refrigerant, at the time of a heating operation or the like when the outdoor air temperature is low, the discharge temperature from a compressor becomes excessively high, which may deteriorate the refrigerant and refrigerating machine oil. Furthermore, although the description of a cooling and heating concurrent operation is provided in Patent Literature 1, there is no description about a method of reducing the discharge temperature. Moreover, in the multi-air-conditioning apparatus for a building, an expansion device, such as an electronic expansion valve, for reducing the pressure of a refrigerant, is installed in the relay unit or the indoor unit, which is remote from the outdoor unit.

In the air-conditioning apparatus disclosed in Patent Literature 2, only the method of injection to the middle of the compressor from the high-pressure liquid pipe is described, and the air-conditioning apparatus cannot handle, for example, a case in which the circulation passage in the refrigeration cycle is reversed (switching between cooling and heating). Furthermore, the air-conditioning apparatus does not support a cooling and heating mixed operation.

The air-conditioning apparatus described in Patent Literature 3 has a configuration in which check valves are arranged in parallel with expansion devices on the indoor side and the outdoor side so that suction-injection of the liquid refrigerant can be performed at the time of heating and cooling. However, a special indoor unit is required for this configuration, and therefore there is a problem in that a normal indoor unit in which a check valve is not connected in parallel with an expansion device cannot be used and the required configuration is not a general-purpose configuration.

SUMMARY

The present invention has been made in order to solve the above-described problems. Accordingly, a safe-operation and long-service-life air-conditioning apparatus is provided which is capable of injecting a refrigerant into a suction side of a compressor either at the time of a cooling operation or a heating operation and capable of reducing the discharge temperature of the compressor regardless of the operation mode.

An air-conditioning apparatus according to the present invention has a refrigeration cycle including a compressor, a first heat exchanger, a first expansion device, and second heat exchangers that are connected by pipes and includes a suction-injection pipe configured to introduce, into a suction side of the compressor, a refrigerant in a liquid or two-phase state that is branched from a refrigerant flow passage through which the refrigerant that transfers heat in the first heat exchanger or the second heat exchangers circulates; a second expansion device arranged at the suction-injection pipe; and a controller configured to regulate, by controlling an opening degree of the second expansion device, a suction-injection flow rate of the refrigerant introduced into the suction side of the compressor through the suction-injection pipe.

In an air-conditioning apparatus according to the present invention, the discharge temperature from the compressor is restrained from rising excessively high even in the case where a refrigerant whose discharge temperature goes high is used by performing suction-injection of the refrigerant into or out of a suction side of the compressor, regardless of the operation mode. Therefore, the air-conditioning apparatus according to the present invention is capable of operating safely without the refrigerant and refrigerating machine oil being deteriorated, thus a longer service life is ensured.

DETAILED DESCRIPTION

Hereinafter, embodiments of the present invention will be described with reference to the drawings.

Embodiment 1

Figure 1:
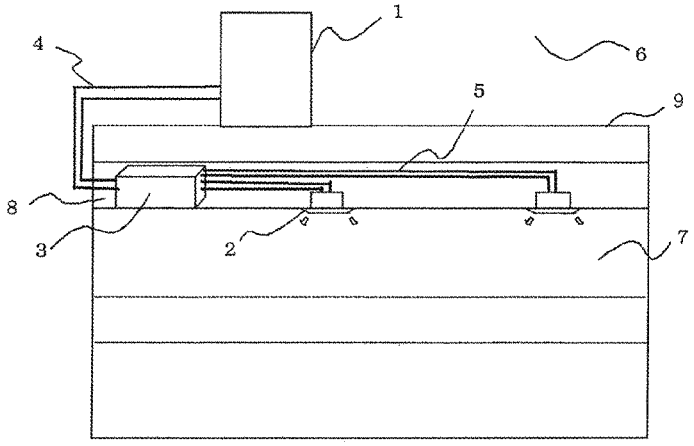
FIG. 1 is a schematic diagram illustrating an installation example of an air-conditioning apparatus according to Embodiment 1 of the present invention.

FIG. 1 is a schematic diagram illustrating an installation example of an air-conditioning apparatus according to Embodiment 1 of the present invention. With reference to FIG. 1, an installation example of the air-conditioning apparatus will be described. This air-conditioning apparatus allows each indoor unit to select freely between a cooling mode and a heating mode as an operation mode by utilizing a refrigeration cycle (a refrigerant circuit A and a heat medium circuit B) which causes refrigerants (a heat-source-side refrigerant and a heat medium) to circulate. In the following drawings including FIG. 1, the correspondence between the sizes of components is not always the same as the actual correspondence.

In FIG. 1, the air-conditioning apparatus according to Embodiment 1 includes an outdoor unit 1 which is a heat source unit, a plurality of indoor units 2, and a heat medium relay unit 3 which is arranged between the outdoor unit 1 and each of the indoor units 2. The heat medium relay unit 3 exchanges heat between a heat-source-side refrigerant and a heat medium. The outdoor unit 1 and the heat medium relay unit 3 are connected by refrigerant pipes 4 through which the heat-source-side refrigerant flows. The heat medium relay unit 3 and the indoor units 2 are connected by pipes (heat medium pipes) 5 through which the heat medium flows. Furthermore, cooling energy or heating energy generated in the outdoor unit 1 is sent to the indoor units 2 via the heat medium relay unit 3.

Generally, the outdoor unit 1 is arranged in an outdoor space 6 (for example, a rooftop, etc.), which is a space outside a structure 9, such as a building, and supplies cooling energy or heating energy to the indoor units 2 via the heat medium relay unit 3. The indoor units 2 are arranged in positions from which cooling air or heating air can be supplied to an indoor space 7 (for example, a living room, etc.), which is a space inside the structure 9, and supply cooling air or heating air to the indoor space 7, which is to be an air-conditioned space. The heat medium relay unit 3 is configured as a unit separated from the outdoor unit 1 and the indoor unit 2 so as to be installed at a position different from the outdoor space 6 and the indoor space 7, and is connected to the outdoor unit 1 and the indoor units 2 by the refrigerant pipes 4 and the pipes 5, respectively, and transmits cooling energy or heating energy supplied from the outdoor unit 1 to the indoor units 2.

As illustrated in FIG. 1, in the air-conditioning apparatus according to Embodiment 1, the outdoor unit 1 and the heat medium relay unit 3 are connected through the two refrigerant pipes 4, and the heat medium relay unit 3 and each of the indoor units 2 are connected through two of the pipes 5. As described above, a simple construction of the air-conditioning apparatus according to Embodiment 1 can be achieved by connecting the units (the outdoor unit 1, the indoor units 2, and the heat medium relay unit 3) using the two pipes (the refrigerant pipes 4 and the pipes 5).

In FIG. 1, an example of the state in which the heat medium relay unit 3 is installed in a space, such as a space above the ceiling, which is a space inside the structure 9 and yet is different from the indoor space 7 (hereinafter, simply referred to as a space 8), is illustrated. Alternatively, the heat medium relay unit 3 may be installed in a shared space or the like where an elevator or the like is located. Furthermore, although an example of the indoor units 2 of a ceiling cassette type is illustrated in FIG. 1, the indoor units 2 are not necessarily of this type, and may be of any type, such as a ceiling concealed type or a ceiling suspended type, as long as they can blow heating air or cooling air to the indoor space 7 directly or through ducts or the like.

FIG. 1 illustrates an example in which the outdoor unit 1 is installed in the outdoor space 6. However, the outdoor unit 1 is not necessarily installed in the above-mentioned position. For example, the outdoor unit 1 may be installed in a surrounded space, such as a machine room provided with a ventilation opening or the like. The outdoor unit 1 may be installed inside the structure 9 as long as waste heat may be discharged to the outside of the structure 9 through an exhaust duct. Alternatively, the outdoor unit 1 of a water-cooled type may be installed inside the structure 9. In whichever location the outdoor unit 1 is installed, no particular problem occurs.

The heat medium relay unit 3 may also be installed in close proximity to the outdoor unit 1. However, in the case where the distance from the heat medium relay unit 3 to each of the indoor units 2 is excessively long, the conveyance power of a heat medium is increased considerably. Therefore, attention needs to be paid to the fact that the energy saving effect is degraded. Moreover, the number of the connected outdoor units 1, indoor units 2, and heat medium relay units 3 is not necessarily equal to the number illustrated in FIG. 1, and may be determined in accordance with the structure 9 for which the air-conditioning apparatus according to Embodiment 1 is installed.

In the case where a plurality of heat medium relay units 3 are connected to a single outdoor unit 1, the plurality of heat medium relay units 3 may be installed in a scattered manner in shared spaces, spaces above the ceiling, or the like of a structure, such as a building. With this arrangement, an air-conditioning load can be handled by an intermediate heat exchanger of each of the heat medium relay units 3. Furthermore, each of the indoor units 2 can be installed at a distance or a height within a conveyance allowable range of a heat medium conveyance device of a corresponding one of the heat medium relay units 3, and the heat medium relay units 3 can thus be arranged over the entire structure such as a building.

Figure 2:
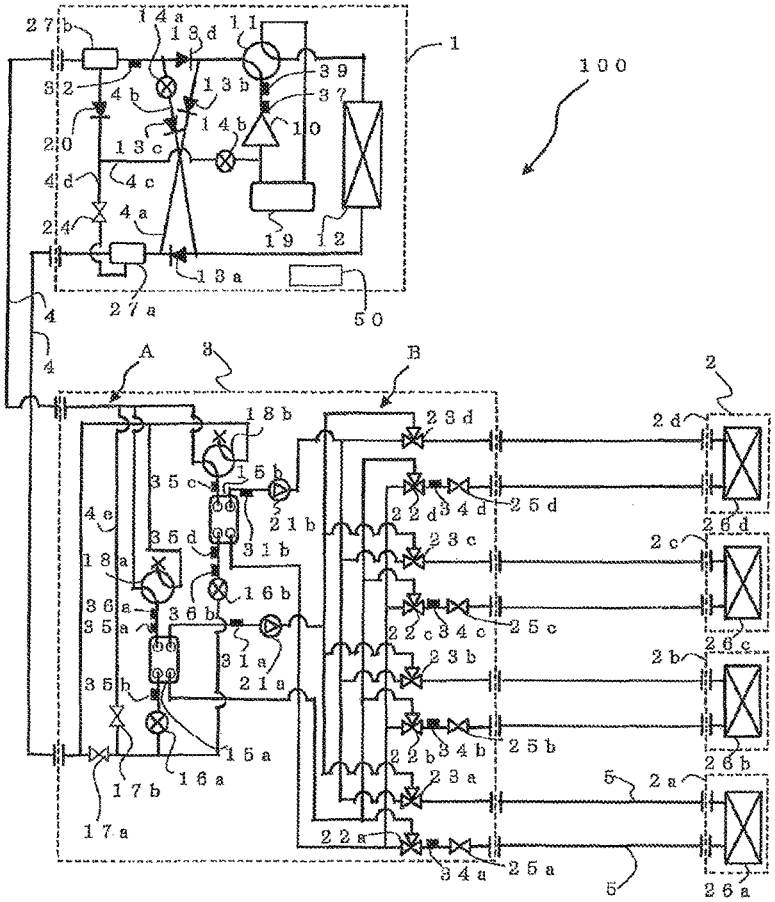
FIG. 2 is a schematic circuit configuration diagram illustrating an example of the circuit configuration of an air-conditioning apparatus according to Embodiment 1 of the present invention.

FIG. 2 is a schematic circuit configuration diagram illustrating an example of the circuit configuration of the air-conditioning apparatus (hereinafter, referred to as the air-conditioning apparatus 100) according to Embodiment 1. With reference to FIG. 2, a detailed configuration of the air-conditioning apparatus 100 will be described. As illustrated in FIG. 2, the outdoor unit 1 and the heat medium relay unit 3 are connected through the refrigerant pipes 4 via an intermediate heat exchanger 15*a* and an intermediate heat exchanger 15*b* provided in the heat medium relay unit 3. Furthermore, the heat medium relay unit 3 and the indoor units 2 are connected through the pipes 5 via the intermediate heat exchanger 15*a* and the intermediate heat exchanger 15*b*. A detailed description of the refrigerant pipes 4 and the pipes 5 will be provided later.

[Outdoor Unit 1]

The outdoor unit 1 includes a compressor 10, a first refrigerant flow switching device 11 such as a four-way valve, a heat-source-side heat exchanger 12, and an accumulator 19 that are connected in series with one another by the refrigerant pipes 4. Furthermore, the outdoor unit 1 includes a first connecting pipe 4*a*, a second connecting pipe 4*b*, a check valve 13*a*, a check valve 13*b*, a check valve 13*c*, and a check valve 13*d*. By providing the first connecting pipe 4*a*, the second connecting pipe 4*b*, the check valve 13*a*, the check valve 13*b*, the check valve 13*c*, and the check valve 13*d*, the flow of a heat-source-side refrigerant flowing into the heat medium relay unit 3 can be maintained in a constant direction, regardless of an operation requested from each of the indoor units 2.

The compressor 10 may be, for example, a capacity-controllable inverter compressor or the like that sucks a heat-source-side refrigerant and compresses the heat-source-side refrigerant into the high-temperature and high-pressure state. The first refrigerant flow switching device 11 performs switching between the flow of a heat-source-side refrigerant at the time of a heating operation (at the time in a heating only operation mode and the time in a heating main operation mode) and the flow of a heat-source-side refrigerant at the time of a cooling operation (at the time in a cooling only operation mode and the time in a cooling main operation mode). The heat-source-side heat exchanger 12 functions as an evaporator at the time of a heating operation and a condenser (or a radiator) at the time of a cooling operation, exchanges heat between air supplied from a fan, which is not illustrated, and a heat-source-side refrigerant, and evaporates and gasifies or condenses and liquefies the heat-source-side refrigerant. The accumulator 19 is provided on the suction side of the compressor 10, and stores an excess refrigerant generated due to a difference between the time of a heating operation and the time of a cooling operation or an excess refrigerant generated due to a change in a transitional operation.

The check valve 13*d* is arranged at a portion of the refrigerant pipe 4 positioned between the heat medium relay unit 3 and the first refrigerant flow switching device 11, and allows a heat-source-side refrigerant to flow only in a specific direction (the direction from the heat medium relay unit 3 to the outdoor unit 1). The check valve 13*a* is arranged at a portion of the refrigerant pipe 4 positioned between the heat-source-side heat exchanger 12 and the heat medium relay unit 3, and allows a heat-source-side refrigerant to flow only in a specific direction (the direction from the outdoor unit 1 to the heat medium relay unit 3). The check valve 13*b* is arranged at the first connecting pipe 4*a*, and causes a heat-source-side refrigerant discharged from the compressor 10 to circulate in the heat medium relay unit 3 at the time of a heating operation. The check valve 13*c* is arranged at the second connecting pipe 4*b*, and causes a heat-source-side refrigerant that has returned from the heat medium relay unit 3 to circulate into the suction side of the compressor 10 at the time of a heating operation.

In the outdoor unit 1, the first connecting pipe 4*a* connects the refrigerant pipe 4 positioned between the first refrigerant flow switching device 11 and the check valve 13*d* with the refrigerant pipe 4 positioned between the check valve 13*a* and the heat medium relay unit 3. In the outdoor unit 1, the second connecting pipe 4*b* connects the refrigerant pipe 4 positioned between the check valve 13*d* and the heat medium relay unit 3 with the refrigerant pipe 4 positioned between the heat-source-side heat exchanger 12 and the check valve 13*a*.

In a refrigeration cycle, a rise in the temperature of a refrigerant causes deterioration of the refrigerant and refrigerating machine oil which circulate within the circuit, and thus, the upper limit of the temperature is set. This upper limit temperature is normally set, for example, at 120 degrees Centigrade. The highest temperature in the refrigeration cycle is a refrigerant temperature on the discharge side (discharge temperature) of the compressor 10. Therefore, control may be performed such that the discharge temperature does not reach 120 degrees Centigrade or higher. If, for example, R410A or the like is used as a refrigerant, the discharge temperature does not usually reach 120 degrees Centigrade under a normal operation. However, if R32 is used as a refrigerant, the discharge temperature becomes high due to its physical properties, and thus, it is necessary to provide means for reducing the discharge temperature in the refrigeration cycle.

Accordingly, the outdoor unit 1 is configured to include a first gas-liquid separator (or a first branching unit) 27*a*, a second gas-liquid separator (or a second branching unit) 27*b*, an opening/closing device 24, a backflow prevention device 20, an expansion device 14*a*, an expansion device 14*b*, a medium pressure detection device 32, a discharged refrigerant temperature detection device 37, a high-pressure detection device 39, a suction-injection pipe 4*c*, a branch pipe 4*d*, and a controller 50. Furthermore, the compressor 10 has a low-pressure shell structure. With this structure, the compressor 10 includes a compression chamber within an air-tight container which is under a refrigerant pressure atmosphere of low pressure, and a low-pressure refrigerant within the air-tight container is sucked into the compression chamber and is compressed. However, the structure of the compressor 10 is not limited thereto.

In addition, a refrigerant introduction port is provided at the flow passage between the compressor 10 and the accumulator 19, and the suction-injection pipe 4*c* for introducing the refrigerant into the suction side of the compressor from the outside of the compressor is provided, so that the refrigerant can be introduced (injected) from the suction-injection pipe 4*c* into the suction side of the compressor. Accordingly, the temperature of the refrigerant discharged from the compressor 10 or the degree of superheat (discharge superheat) of the refrigerant discharged from the compressor 10 can be reduced.

By controlling the opening/closing device 24, the expansion device 14*a*, the expansion device 14*b*, and so on with the controller 50, the discharge temperature of the compressor 10 can be reduced, thus a safe operation being achieved. A more specific control operation will be explained later in the explanation of an operation in each operation mode. The controller 50 includes a microcomputer or the like. On the basis of detection information obtained by various detection devices and instructions from a remote controller, the controller 50 controls, not only the above-described actuators, but also the driving frequency of the compressor 10, the rotation speed (including ON/OFF) of the fan, the switching operation of the first refrigerant flow switching device 11, and so on, and executes various operation modes, which will be described below.

The branch pipe 4*d* connects the gas-liquid separator 27*a*, which is provided on the downstream side of the check valve 13*a* and the check valve 13*b*, with the gas-liquid separator 27*b*, which is provided on the upstream side of the check valve 13*d* and the check valve 13*c*. In the branch pipe 4*d*, the backflow prevention device 20 and the opening/closing device 24 are arranged in this order from the side of the gas-liquid separator 27*b*. The suction-injection pipe 4*c* connects the branch pipe 4*d* positioned between the backflow prevention device 20 and the expansion device 14*b* to the refrigerant introduction port, which is arranged on the suction side of the compressor 10. The suction-injection pipe 4*c* is connected to the branch pipe 4*d* via a connection port formed at the branch pipe 4*d*.

The gas-liquid separator 27*a* separates the refrigerant that has flowed via the check valve 13*a* or the check valve 13*b* into a flow into the refrigerant pipe 4 and a flow into the branch pipe 4*d*. The gas-liquid separator 27*b* separates the refrigerant that has returned from the heat medium relay unit 3 into a flow into the branch pipe 4*d* and a flow into the check valve 13*b* or the check valve 13*c*. The gas-liquid separator 27*a* and the gas-liquid separator 27*b* each have, in an operation mode in which a liquid refrigerant flows into the gas-liquid separators, a function of separating part of the liquid refrigerant from the liquid refrigerant which has flowed into the gas-liquid separator, and in an operation mode in which a two-phase refrigerant flows into the gas-liquid separator, a function of separating part of a liquid refrigerant from the two-phase refrigerant which has flowed into the gas-liquid separator. The backflow prevention device 20 allows the refrigerant to flow only in a specific direction (the direction from the gas-liquid separator 27*b* to the gas-liquid separator 27*a*). The opening/closing device 24 includes a two-way valve or the like and opens and closes the branch pipe 4*d*. The expansion device 14*a* is provided on the upstream side of the check valve 13*c* in the second connecting pipe 4*b*, and decompresses and expands the refrigerant flowing through the second connecting pipe 4*b*. The expansion device 14*b* is provided at the suction-injection pipe 4*c*, and decompresses and expands the refrigerant flowing through the suction-injection pipe 4*c*.

The medium pressure detection device 32 is provided on the upstream side of the check valve 13*d* and the expansion device 14*a* and on the downstream side of the gas-liquid separator 27*b*, and detects the pressure of the refrigerant flowing through the refrigerant pipe 4 at a position at which the medium pressure detection device 32 is installed. The discharged refrigerant temperature detection device 37 is provided on the discharge side of the compressor 10, and detects the temperature of the refrigerant discharged from the compressor 10. The high-pressure detection device 39 is provided on the discharge side of the compressor 10, and detects the pressure of the refrigerant discharged from the compressor 10.

The difference in the discharge temperature between when R410A is used as a refrigerant and when R32 is used as a refrigerant will be briefly explained. The case in which the evaporating temperature in a refrigeration cycle is zero degrees Centigrade, the condensing temperature is 49 degrees Centigrade, and the superheat (degree of superheat) of the refrigerant sucked into the compressor is zero degrees Centigrade will be considered. If R410A is used as a refrigerant and adiabatic compression (isentropic compression) is performed, the discharge temperature of the compressor 10 is about 70 degrees Centigrade, due to the physical properties of the refrigerant. In contrast, if R32 is used as a refrigerant and adiabatic compression (isentropic compression) is performed, the discharge temperature of the compressor 10 is about 86 degrees Centigrade, due to the physical properties of the refrigerant. Specifically, when R32 is used as a refrigerant, the discharge temperature rises by about 16 degrees Centigrade than when R410A is used as a refrigerant.

In an actual operation, polytropic compression, which is an operation less efficient than the adiabatic compression, is performed in the compressor 10, and thus, the discharge temperature becomes higher than the above-described value. When R410A is used as a refrigerant, it is not unusual that an operation is performed in the state in which the discharge temperature exceeds 100 degrees Centigrade. Under the condition that an operation is performed using R410A in the state in which the discharge temperature exceeds 104 degrees Centigrade, in the case of the use of R32, the discharge temperature exceeds the upper limit temperature, that is, 120 degrees Centigrade. Therefore, it is necessary to reduce the discharge temperature.

Here, the case where the compressor 10 has a low-pressure shell structure in which a compression chamber and a motor are accommodated in an air-tight container (compressor shell) and the air-tight container in the compressor 10 has a low pressure refrigerant atmosphere and where, for example, the compression chamber is arranged in an upper portion of the air-tight container and the motor is arranged in a lower portion of the air-tight container, will be considered. In the compressor 10 having such a structure, a low-pressure refrigerant sucked into the lower portion of the air-tight container passes around the motor and is sucked into the compression chamber, and after being compressed, the refrigerant is flowed out to the upper portion of the air-tight container which is partitioned off so that the refrigerant is prevented from circulating in the lower portion of the air-tight container, and then the refrigerant is discharged from the compressor 10. The air-tight container is made of metal and is in contact with a low-temperature and low-pressure refrigerant in the lower portion and a high-temperature and high-pressure refrigerant in the upper portion. Furthermore, the motor also generates heat.

Therefore, the refrigerant sucked into the compressor 10 is heated by the air-tight container and the motor, and reaches the compression chamber after the degree of superheat increases. Thus, when the liquid or the two-phase, low-temperature and low-pressure refrigerant is suction-injected into the suction side of the compressor 10, the degree of superheat of the refrigerant sucked into the compression chamber can be decreased, and the discharge temperature can be decreased. Furthermore, in the case where the compressor 10 has a high-pressure shell structure, in which the air-tight container has high pressure, the refrigerant sucked into the compressor 10 directly enters the compression chamber and is compressed. Therefore, when a liquid or two-phase, low-temperature and low-pressure refrigerant is suction-injected into the refrigerant sucked into the compressor 10, the refrigerant starting to be compressed enters the two-phase state, and the discharge temperature decreases by the latent heat.

Regarding a way how to control the suction-injection flow rate into the suction side of the compressor 10, preferably, the discharge temperature is controlled to a target value, for example, 100 degrees Centigrade, and the control target value is changed in accordance with outdoor air temperature. Furthermore, control may be performed such that suction-injection is performed if the discharge temperature is likely to exceed a target value, for example, 110 degrees Centigrade and such that suction-injection is not performed if the discharge temperature is likely to be equal to or lower than the target value. Furthermore, control may be performed such that the discharge temperature falls within a target range, for example, from 80 to 100 degrees Centigrade and such that the suction-injection flow rate is increased if the discharge temperature is likely to exceed the upper limit of the target range and the suction-injection flow rate is decreased if the discharge temperature is likely to be lower than the lower limit of the target range.

Preferably, the discharge superheat (discharge heat degree) is calculated using a high pressure detected by the high-pressure detection device 39 and a discharge temperature detected by the discharged refrigerant temperature detection device 37, the suction-injection flow rate is controlled such that the discharge superheat becomes a target value, for example, 30 degrees Centigrade, and the control target value is changed in accordance with outdoor air temperature. Alternatively, control may be performed such that suction-injection is performed if the discharge superheat is likely to exceed a target value, for example, 40 degrees Centigrade, and such that injection is not performed if the discharge superheat is likely to be equal to or lower than the target value. Furthermore, control may be performed such that the discharge superheat falls within a target range, for example, from 10 to 40 degrees Centigrade and such that the suction-injection flow rate is increased if the discharge superheat is likely to exceed the upper limit of the target range and the suction-injection flow rate is decreased if the discharge superheat is likely to be lower than the lower limit of the target range.

Furthermore, as a method of causing a refrigerant in a two-phase state to be sucked into the compressor 10, a method of causing a refrigerant in a two-phase state to be flowed out of an evaporator. Since the accumulator 19 is arranged on the upstream side of the compressor 10, the refrigerant which has flowed out of the evaporator first flows into the accumulator 19. The accumulator 19 has a structure that can store a certain amount of refrigerant. Unless a certain amount or more of refrigerant is accumulated, two-phase refrigerant including a large amount of liquid refrigerant does not flow out of the accumulator 19 and into the compressor 10.

However, the amount of refrigerant enclosed within the refrigeration cycle has a limit, and only excess refrigerant is stored within the accumulator 19. Thus, it is not possible to control the two-phase refrigerant including the amount of liquid refrigerant required to reduce the discharge temperature to be supplied to the compressor 10 in accordance with the discharge temperature. Therefore, it is necessary to perform suction-injection of the liquid refrigerant between the accumulator 19 and the compressor 10 to supply the required liquid refrigerant to the compressor 10.

The case in which R32 circulates within the refrigerant pipes 4 has been explained above. However, the refrigerant is not limited to R32. Any refrigerant can decrease the discharge temperature and can obtain effects similar to those described above if the configuration of the present invention is employed, as long as the refrigerant causes the discharge temperature to become higher than that in the case of using conventional R410A when the condensing temperature, the evaporating temperature, the superheat (degree of superheat), the subcool (degree of subcooling), and the efficiency of the compressor are the same as those of R410A. In particular, if a refrigerant that causes the discharge temperature to become higher than R410A by three degrees Centigrade or higher is used, more positive effects can be obtained.

Figure 3:
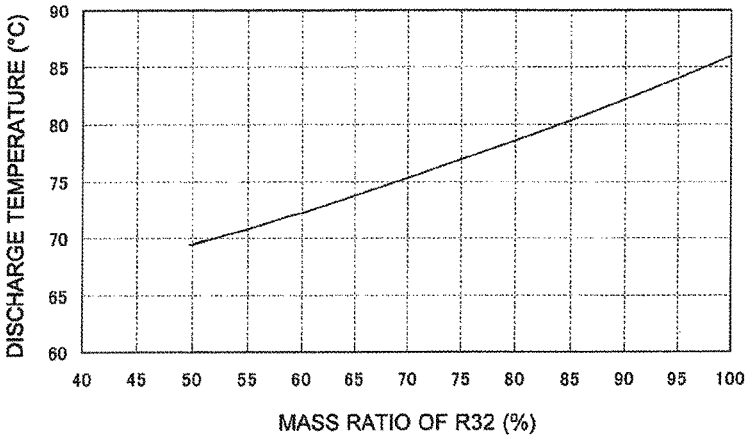
FIG. 3 is a relationship diagram illustrating the relationship between the mass ratio of R32 and discharge temperature in the case where a mixed refrigerant is used.

FIG. 3 is a graph illustrating a change in the discharge temperature relative to the mass ratio of R32 in the case where trial calculation of the discharge temperature is performed in a method similar to that described above when a mixed refrigerant of R32 and HFO1234yf, which is a tetrafluoropropene refrigerant having a small global warming potential and having a chemical formula represented by $CF_3$ CF═$CH_2$, is used. As is clear from FIG. 3, the discharge temperature is about 70 degrees Centigrade, which is substantially the same as the discharge temperature of R410A, when the mass ratio of R32 is 52%, and the discharge temperature is about 73 degrees Centigrade, which is higher than that of R410A by three degrees Centigrade, when the mass ratio of R32 is 62%. Accordingly, in the case of the mixed refrigerant of R32 and HFO1234yf, when a mixed refrigerant containing R32 having a mass ratio of 62% or higher is used, more positive effects can be obtained by reducing the discharge temperature by performing suction-injection.

Furthermore, as is clear from the calculation of the discharge temperature using a method similar to that described above for a mixed refrigerant of R32 and HFO1234ze, which is a tetrafluoropropene refrigerant having a small global warming potential and having a chemical formula represented by $CF_3$ CH═CHF, the discharge temperature is about 70 degrees Centigrade, which is substantially the same as the discharge temperature of R410A, when the mass ratio of R32 is 34% and the discharge temperature is about 73 degrees Centigrade, which is higher than that of R410A by three degrees Centigrade, when the mass ratio of R32 is 43%. Accordingly, when the mass ratio of R32 is 43% or higher, more positive effects can be obtained by reducing the discharge temperature by performing suction-injection.

These trial calculations were made using REFPROP Version 8.0 released by NIST (National Institute of Standards and Technology). Additionally, the type of mixed refrigerant is not limited to the above-described type. The use of a mixed refrigerant containing a small amount of another refrigerant component does not greatly affect the discharge temperature, and effects similar to those described above can be obtained. For example, a mixed refrigerant containing R32, HFO1234yf, and a small amount of another refrigerant may be used. As stated above, the above-described calculations are made, assuming that adiabatic compression is performed. However, the actual compression is performed by polytropic compression, and thus, the temperature is higher than the above-described temperature by several tens of degrees Centigrade, for example, by 20 degrees Centigrade or higher.

[Indoor Units 2]

A use-side heat exchanger 26 is provided in each of the indoor units 2. The use-side heat exchangers 26 are connected to heat medium flow control devices 25 and second heat medium flow switching devices 23 in the heat medium relay unit 3 through the pipes 5. The use-side heat exchangers 26 perform heat exchange between air supplied from a fan, which is not illustrated, and a heat medium, and generate heating air or cooling air to be supplied to the indoor space 7.

FIG. 2 illustrates an example of the case where four indoor units 2 are connected to the heat medium relay unit 3, and the indoor units 2 are illustrated as an indoor unit 2*a*, an indoor unit 2*b*, an indoor unit 2*c*, and an indoor unit 2*d* in this order from the bottom of the drawing. In association with the indoor units 2*a* to 2*d*, the use-side heat exchangers 26 are illustrated as a use-side heat exchanger 26*a*, a use-side heat exchanger 26*b*, a use-side heat exchanger 26*c*, and a use-side heat exchanger 26*d* in this order from the bottom side of the drawing. As in FIG. 1, the number of connected indoor units 2 is not necessarily four, as illustrated in FIG. 2.

[Heat Medium Relay Unit 3]

The two intermediate heat exchangers 15, two expansion devices 16, two opening/closing devices 17, two second refrigerant flow switching devices 18, two pumps 21, four first heat medium flow switching devices 22, the four second heat medium flow switching devices 23, and the four heat medium flow control devices 25 are provided in the heat medium relay unit 3.

The two intermediate heat exchangers 15 (the intermediate heat exchanger 15*a* and the intermediate heat exchanger 15*b*) function as condensers (radiators) or evaporators, perform heat exchange between a heat-source-side refrigerant and a heat medium, and transmit cooling energy or heating energy generated in the outdoor unit 1 and stored in the heat-source-side refrigerant to the heat medium. The intermediate heat exchanger 15*a* is arranged between an expansion device 16*a* and a second refrigerant flow switching device 18*a* in the refrigerant circuit A, and is used for cooling the heat medium in the cooling and heating mixed operation mode. The intermediate heat exchanger 15*b* is arranged between an expansion device 16*b* and a second refrigerant flow switching device 18*b* in the refrigerant circuit A, and is used for heating the heat medium in the cooling and heating mixed operation mode.

The two expansion devices 16 (the expansion device 16*a* and the expansion device 16*b*) each have a function as a pressure reducing valve or an expansion valve, and each decompress and expand a heat-source-side refrigerant. The expansion device 16*a* is arranged on the upstream side of the intermediate heat exchanger 15*a* in the flow of a heat-source-side refrigerant at the time of a cooling operation. The expansion device 16*b* is arranged on the upstream side of the intermediate heat exchanger 15*b* in the flow of a heat-source-side refrigerant at the time of a cooling operation. The two expansion devices 16 each preferably include a device whose opening degree (opening area) can be variably controlled, for example, an electronic expansion valve or the like.

The two opening/closing devices 17 (an opening/closing device 17*a* and an opening/closing device 17*b*) each include a two-way valve or the like and open and close the refrigerant pipes 4. The opening/closing device 17*a* is arranged at the refrigerant pipe 4 on the entry side of a heat-source-side refrigerant. The opening/closing device 17*b* is arranged at a pipe (a bypass pipe 4*e*) which connects the entry side and exit side for a heat-source-side refrigerant of the refrigerant pipe 4 together. The opening/closing devices 17 may be of any type as long as they can open and close the refrigerant pipes 4. The opening/closing devices 17 may be, for example, electronic expansion valves whose opening degree can be variably controlled.

The two second refrigerant flow switching devices 18 (the second refrigerant flow switching device 18*a* and the second refrigerant flow switching device 18*b*) each include a four-way valve or the like and perform switching of the flow of a heat-source-side refrigerant so that the corresponding intermediate heat exchanger 15 operates as a condenser or an evaporator in accordance with an operation mode. The second refrigerant flow switching device 18*a* is arranged on the downstream side of the intermediate heat exchanger 15*a* in the flow of a heat-source-side refrigerant at the time of a cooling operation. The second refrigerant flow switching device 18*b* is arranged on the downstream side of the intermediate heat exchanger 15*b* in the flow of a heat-source-side refrigerant at the time of a cooling only operation.

The two pumps 21 (a pump 21*a* and a pump 21*b*) cause the heat medium flowing through the pipes 5 to circulate in the heat medium circuit B. The pump 21*a* is arranged at the pipe 5 positioned between the intermediate heat exchanger 15*a* and the second heat medium flow switching devices 23. The pump 21*b* is arranged at the pipe 5 positioned between the intermediate heat exchanger 15*b* and the second heat medium flow switching devices 23. The two pumps 21 each preferably include, for example, a capacity-controllable pump or the like, and the flow rate of the pumps 21 is adjustable in accordance with the size of load in the indoor units 2.

The four first heat medium flow switching devices 22 (first heat medium flow switching devices 22*a* to 22*d*) each include a three-way valve or the like and perform switching of the flow passage of the heat medium. The first heat medium flow switching devices 22 are arranged in such a manner that the number of the first heat medium flow switching devices 22 corresponds to the number of the indoor units 2 installed (here, four). One of the three ways of each of the first heat medium flow switching devices 22 is connected to the intermediate heat exchanger 15*a*, another one of the three ways is connected to the intermediate heat exchanger 15*b*, and the other one of the three ways is connected to the corresponding one of the heat medium flow control devices 25. The first heat medium flow switching devices 22 are arranged on the exit side of the heat medium flow passages of the use-side heat exchangers 26. The first heat medium flow switching devices 22 are illustrated as the first heat medium flow switching device 22*a*, the first heat medium flow switching device 22*b*, the first heat medium flow switching device 22*c*, and the first heat medium flow switching device 22*d* in this order from the bottom side of the drawing, in association with the indoor units 2. Furthermore, the switching of the heat medium flow passages includes partial switching from one to another way as well as complete switching from one to another way.

The four second heat medium flow switching devices 23 (second heat medium flow switching devices 23*a* to 23*d*) each include a three-way valve or the like and perform switching of the flow of the heat medium. The second heat medium flow switching devices 23 are arranged in such a manner that the number of the second heat medium flow switching devices 23 corresponds to the number of the indoor units 2 installed (here, four). One of the three ways of each of the second heat medium flow switching devices 23 is connected to the intermediate heat exchanger 15*a*, another one of the three ways is connected to the intermediate heat exchanger 15*b*, and the other one of the three ways is connected to the corresponding one of the use-side heat exchangers 26. The second heat medium flow switching devices 23 are arranged on the entry side of the heat medium flow passages of the use-side heat exchangers 26. The second heat medium flow switching devices 23 are illustrated as the second heat medium flow switching device 23*a*, the second heat medium flow switching device 23*b*, the second heat medium flow switching device 23*c*, and the second heat medium flow switching device 23*d* in this order from the bottom side of the drawing, in association with the indoor units 2. Furthermore, the switching of the heat medium flow passages includes partial switching from one to another way as well as complete switching from one to another way.

The four heat medium flow control devices 25 (heat medium flow control devices 25*a* to 25*d*) each include a two-way valve or the like whose opening area can be controlled and control the flow rate of the heat medium flowing through the corresponding pipes 5. The heat medium flow control devices 25 are arranged in such a manner that the number of the heat medium flow control devices 25 corresponds to the number of the indoor units 2 installed (here, four). One of the two ways of each of the heat medium flow control devices 25 is connected to the corresponding one of the use-side heat exchangers 26 and the other one of the two ways is connected to the corresponding one of the first heat medium flow switching devices 22. The heat medium flow control devices 25 are arranged on the exit side of the heat medium flow passages of the use-side heat exchangers 26. That is, the heat medium flow control devices 25 regulate the amount of heat medium flowing into the indoor units 2 on the basis of the temperature of the heat medium flowing into the indoor units 2 and the temperature of the heat medium flowing out of the indoor units 2, and are capable of supplying an optimal amount of heat medium corresponding to the indoor load to the indoor units 2.

The heat medium flow control devices 25 are illustrated as the heat medium flow control device 25*a*, the heat medium flow control device 25*b*, the heat medium flow control device 25*c*, and the heat medium flow control device 25*d* in this order from the bottom side of the drawing, in association with the indoor units 2. The heat medium flow control devices 25 may be arranged on the entry side of the heat medium flow passages of the use-side heat exchangers 26. Furthermore, the heat medium flow control devices 25 may be arranged at positions on the entry side of the heat medium flow passages of the use-side heat exchangers 26 and between the second heat medium flow switching devices 23 and the use-side heat exchangers 26. Furthermore, in the case of stopping, thermo-off, or the like, which requires no load, in the indoor units 2, by fully-closing the heat medium flow control devices 25, heat medium supply to the indoor units 2 can be stopped.

The heat medium relay unit 3 includes various detection devices (two first temperature sensors 31, four second temperature sensors 34, four third temperature sensors 35, and two pressure sensors 36). Information (temperature information and pressure information) detected by these detection devices are transmitted to a controller (for example, the controller 50) that performs integrated control of the operation of the air-conditioning apparatus 100, and is used for controlling the driving frequency of the compressor 10, the rotation speed of a fan, which is not illustrated, switching of the first refrigerant flow switching device 11, the driving frequency of the pumps 21, switching of the second refrigerant flow switching devices 18, switching of the flow passage of the heat medium, and the like. Although the state in which the controller 50 is provided inside the outdoor unit 1 has been described above, the arrangement is not limited thereto and may be provided so as to be capable of communicating with the heat medium relay unit 3, the indoor units 2, or individual units.

The two first temperature sensors 31 (a first temperature sensor 31*a* and a first temperature sensor 31*b*) each detect the temperature of the heat medium that has flowed out of the corresponding intermediate heat exchanger 15, that is, the temperature of the heat medium at the exit of the corresponding intermediate heat exchanger 15, and each include, for example, a thermistor or the like. The first temperature sensor 31*a* is arranged at the pipe 5 on the entry side of the pump 21*a*. The first temperature sensor 31*b* is arranged at the pipe 5 on the entry side of the pump 21*b*.

The four second temperature sensors 34 (second temperature sensors 34*a* to 34*d*) are arranged between the first heat medium flow switching devices 22 and the flow control devices 25, each detect the temperature of the heat media that have flowed out of the use-side heat exchangers 26, and each may include a thermistor or the like. The second temperature sensors 34 are arranged in such a manner that the number of the second temperature sensors 34 corresponds to the number of the indoor units 2 installed (here, four). The second temperature sensors 34 are illustrated as the second temperature sensor 34*a*, the second temperature sensor 34*b*, the second temperature sensor 34*c*, and the second temperature sensor 34*d* in this order from the bottom side of the drawing, in association with the indoor units 2.

The four third temperature sensors 35 (third temperature sensors 35*a* to 35*d*) are arranged on the entry side or exit side of heat-source-side refrigerants of the intermediate heat exchangers 15, each detect the temperature of the heat-source-side refrigerants flowing into the intermediate heat exchangers 15 or the temperature of the heat-source-side refrigerants flowing out of the intermediate heat exchanges 15, and each may include a thermistor or the like. The third temperature sensor 35*a* is arranged between the intermediate heat exchanger 15*a* and the second refrigerant flow switching device 18*a*. The third temperature sensor 35*b* is arranged between the intermediate heat exchanger 15*a* and the expansion device 16*a*. The third temperature sensor 35*c* is arranged between the intermediate heat exchanger 15*b* and the second refrigerant flow switching device 18*b*. The third temperature sensor 35*d* is arranged between the intermediate heat exchanger 15*b* and the expansion device 16*b*.

A pressure sensor 36*b* is arranged at a position similar to the position at which the third temperature sensor 35*d* is arranged, between the intermediate heat exchanger 15*b* and the expansion device 16*a*, and detects the pressure of a heat-source-side refrigerant flowing between the intermediate heat exchanger 15*b* and the expansion device 16*b*. A pressure sensor 36*a* is arranged at a position similar to the position at which the third temperature sensor 35*a* is arranged, between the intermediate heat exchanger 15*a* and the second refrigerant flow switching device 18*a*, and detects the pressure of a heat-source-side refrigerant flowing between the intermediate heat exchanger 15*a* and the second refrigerant flow switching device 18*a*.

The heat medium relay unit 3 includes a controller, which is not illustrated, including a microcomputer. The controller controls driving of the pumps 21, the opening degree of the expansion devices 16, opening and closing of the opening/closing devices 17, switching of the second refrigerant flow switching devices 18, switching of the first heat medium flow switching devices 22, switching of the second heat medium flow switching devices 23, the opening degree of the heat medium flow control devices 25, and so on, on the basis of detection information obtained by various detection devices and instructions from a remote controller, and executes various operation modes, which will be described below. The controller may be arranged in only one of the outdoor unit 1 and the heat medium relay unit 3. That is, the controller 50 arranged in the outdoor unit 1 may control various devices provided in the heat medium relay unit 3.

The pipes 5 through which flows of the heat medium flow include pipes connected to the intermediate heat exchanger 15*a* and pipes connected to the intermediate heat exchanger 15*b*. The pipes 5 are branched in accordance with the number of the indoor units 2 connected to the heat medium relay unit 3 (here, four branches for each pipe). The pipes 5 are connected through the first heat medium flow switching devices 22 and the second heat medium flow switching devices 23. By controlling the first heat medium flow switching devices 22 and the second heat medium flow switching devices 23, a determination as to whether the heat medium from the intermediate heat exchanger 15*a* is to be flowed into the use-side heat exchangers 26 or the heat medium from the intermediate heat exchanger 15*b* is to be flowed into the use-side heat exchangers 26, is made.

In the air-conditioning apparatus 100, the compressor 10, the first refrigerant flow switching device 11, the heat-source-side heat exchanger 12, the opening/closing devices 17, the second refrigerant flow switching devices 18, a refrigerant flow passage for the intermediate heat exchanger 15*a*, the expansion devices 16, and the accumulator 19 are connected through the refrigerant pipes 4 to configure the refrigerant circuit A. Furthermore, a heat medium flow passage for the intermediate heat exchanger 15*a*, the pumps 21, the first heat medium flow switching devices 22, the heat medium flow control devices 25, the use-side heat exchangers 26, and the second heat medium flow switching devices 23 are connected through the pipes 5 to configure the heat medium circuit B. That is, the plurality of use-side heat exchangers 26 are connected in parallel to each of the intermediate heat exchangers 15, so that the heat medium circuit B is formed as a plural system.

Accordingly, in the air-conditioning apparatus 100, the outdoor unit 1 and the heat medium relay unit 3 are connected through the intermediate heat exchanger 15*a* and the intermediate heat exchanger 15*b* provided in the heat medium relay unit 3, and the heat medium relay unit 3 and the indoor units 2 are connected through the intermediate heat exchanger 15*a* and the intermediate heat exchanger 15*b*. That is, in the air-conditioning apparatus 100, heat exchange is performed, in the intermediate heat exchanger 15*a* and the intermediate heat exchanger 15*b*, between a heat-source side refrigerant circulating in the refrigerant circuit A and a heat medium circulating in the heat medium circuit B.

[Operation Modes]

Various operation modes executed by the air-conditioning apparatus 100 will be explained. The air-conditioning apparatus 100 is capable of performing, with each of the indoor units 2, a cooling operation or a heating operation on the basis of an instruction from the respective indoor units 2. That is, the air-conditioning apparatus 100 is capable of allowing all the indoor units 2 to perform the same operation and also allowing the individual indoor units 2 to perform different operations.

The operation modes executed by the air-conditioning apparatus 100 include a cooling only operation mode in which all of the operating indoor units 2 perform cooling operations, a heating only operation mode in which all of the operating indoor units 2 perform heating operations, a cooling main operation mode, which is a mode in which cooling load is larger than heating load of a cooling and heating mixed operation mode in which a cooling operation and a heating operation coexist, and a heating main operation mode, which is a mode in which the heating load is larger than the cooling load of the cooling and heating mixed operation mode. Hereinafter, the various operation modes will be explained, together with the flow of the heat-source side refrigerant and the heat medium.

[Cooling Only Operation Mode]

Figure 4:
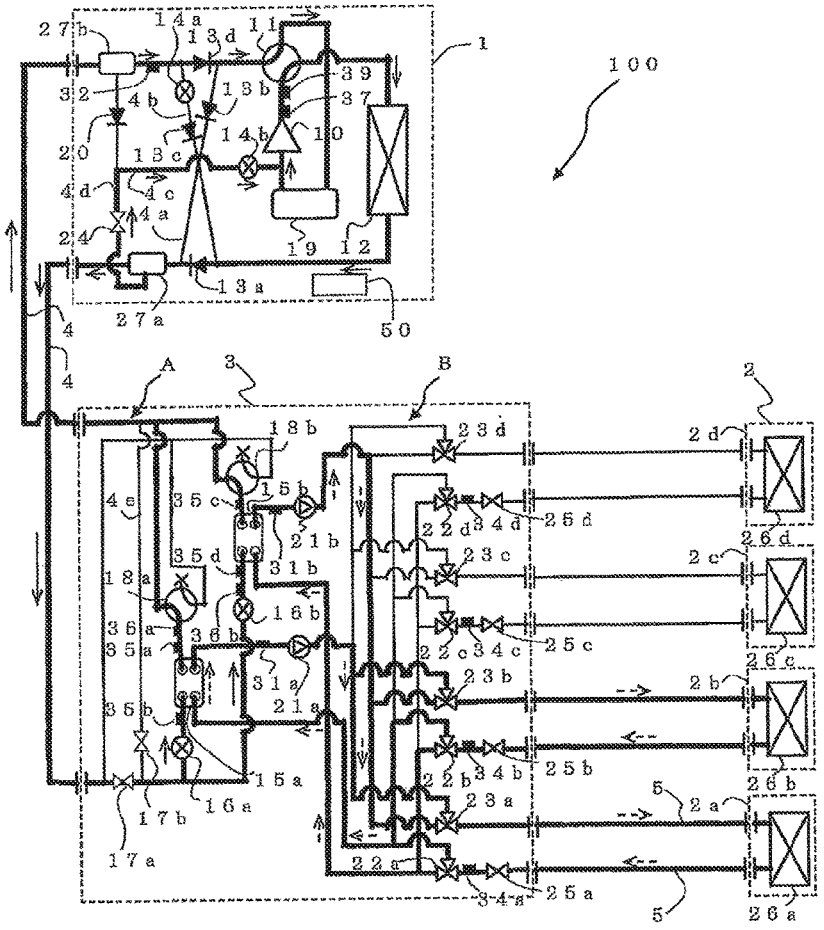
FIG. 4 is a refrigerant circuit diagram illustrating the flow of a refrigerant when the air-conditioning apparatus according to Embodiment 1 of the present invention is in a cooling only operation mode.

FIG. 4 is a refrigerant circuit diagram illustrating the flow of a refrigerant when the air-conditioning apparatus 100 is in the cooling only operation mode. With reference to FIG. 4, the cooling only operation mode will be explained by way of an example of the case where cooling load is generated in only in the use-side heat exchanger 26*a* and the use-side heat exchanger 26*b*. In FIG. 4, pipes expressed by thick lines represent pipes through which the refrigerant (the heat-source-side refrigerant and heat medium) flows. Furthermore, in FIG. 4, the direction of the flow of the heat-source-side refrigerant is expressed by solid-line arrows, and the direction of the flow of the heat medium is expressed by broken-line arrows.

In the case of the cooling only operation mode illustrated in FIG. 4, the outdoor unit 1 performs switching of the first refrigerant flow switching device 11 such that a heat-source-side refrigerant discharged from the compressor 10 flows into the heat-source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between each of the intermediate heat exchanger 15*a* and the intermediate heat exchanger 15*b* and the use-side heat exchanger 26*a* and between each of the intermediate heat exchanger 15*a* and the intermediate heat exchanger 15*b* and the use-side heat exchanger 26*b*.

First, the flow of a heat-source-side refrigerant in the refrigerant circuit A will be explained.

A low-temperature and low-pressure refrigerant is compressed by the compressor 10 and is discharged as a high-temperature and high-pressure gas refrigerant. The high-temperature and high-pressure gas refrigerant discharged from the compressor 10 passes through the first refrigerant flow switching device 11 and flows into the heat-source-side heat exchanger 12. Then, the gas refrigerant is condensed and liquefied by the heat-source-side heat exchanger 12 into the high-pressure liquid refrigerant while transferring heat to outdoor air. The high-pressure liquid refrigerant that has flowed out of the heat-source-side heat exchanger 12 passes through the check valve 13*a*, partially flows out of the outdoor unit 1 via the gas-liquid separator 27*a*, passes through the refrigerant pipe 4, and flows into the heat medium relay unit 3. The high-pressure liquid refrigerant that has flowed into the heat medium relay unit 3 passes through the opening/closing device 17*a*, is split out, and is expanded by the expansion device 16*a* and the expansion device 16*b* into the low-temperature and low-pressure two-phase refrigerant.

The two-phase refrigerant flows into the intermediate heat exchanger 15*a* and the intermediate heat exchanger 15*b* operating as evaporators, and turns into the low-temperature and low-pressure gas refrigerant while cooling the heat medium by receiving heat from the heat medium circulating in the heat medium circuit B. The gas refrigerant discharged from the intermediate heat exchanger 15*a* and the intermediate heat exchanger 15*b* passes through the second refrigerant flow switching device 18*a* and the second refrigerant flow switching device 18*b*, flows out of the heat medium relay unit 3, passes through the refrigerant pipe 4, and flows into the outdoor unit 1 again. The refrigerant that has flowed into the outdoor unit 1 passes through the gas-liquid separator 27*b* and the check valve 13*d*, passes through the first refrigerant flow switching device 11 and the accumulator 19, and is sucked into the compressor 10 again.

At this time, the opening degree (opening area) of the expansion device 16*a* is controlled such that the superheat (degree of superheat) obtained as the difference between the temperature detected by the third temperature sensor 35*a* and the temperature detected by the third temperature sensor 35*b* is maintained constant. Similarly, the opening degree of the expansion device 16*b* is controlled such that the superheat obtained as the difference between the temperature detected by the third temperature sensor 35*c* and the temperature detected by the third temperature sensor 35*d* is maintained constant. Furthermore, the opening/closing device 17*a* is opened, and the opening/closing device 17*b* is closed.

Figure 5:
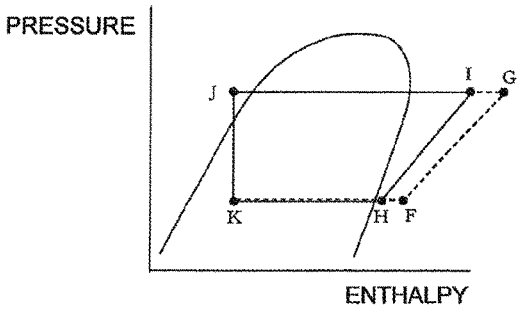
FIG. 5 is a p-h diagram (pressure-enthalpy diagram) illustrating the transition of the state of a heat-source-side refrigerant when the air-conditioning apparatus according to Embodiment 1 of the present invention is in a cooling only operation mode.

In the case of a refrigerant such as R32, since the discharge temperature of the compressor 10 is high, the discharge temperature is reduced by using a suction-injection circuit. An operation performed at this time will be explained with reference to FIG. 4 and a p-h diagram (pressure-enthalpy diagram) in FIG. 5. FIG. 5 is a p-h diagram (pressure-enthalpy diagram) representing the transition of the state of a heat-source-side refrigerant in the cooling only operation mode. In FIG. 5, the vertical axis represents pressure and the horizontal axis represents enthalpy.

In the cooling only operation mode, the refrigerant that has been sucked into the compressor 10 and compressed by the compressor 10 (point I in FIG. 5) is condensed and liquefied into the high-pressure liquid refrigerant by the heat-source-side heat exchanger 12 (point J in FIG. 5), and reaches the gas-liquid separator 27*a* via the check valve 13*a*. The opening/closing device 24 is opened, and the high-pressure liquid refrigerant is separated by the gas-liquid separator 27*a*. Part of the refrigerant that has been separated by the gas-liquid separator 27*a* is flowed into the suction-injection pipe 4*c* via the opening/closing device 24 and the branch pipe 4*d*. The refrigerant that has flowed into the suction-injection pipe 4*c* is decompressed by the expansion device 14*b* into the two-phase, low-temperature and low-pressure refrigerant (point K in FIG. 5). Then, the refrigerant flows into the flow passage between the compressor 10 and the accumulator 19.

In the case where the compressor 10 is of a low-pressure shell type, within the compressor 10, sucked refrigerant and oil flow into a lower portion thereof, a motor is arranged in an intermediate portion thereof, and a high-temperature and high-pressure refrigerant compressed by a compassion chamber is discharged into a discharge chamber inside an air-tight container from an upper portion thereof and then discharged from the compressor 10. Therefore, since the air-tight container, which is made of metal, in the compressor 10 includes a portion exposed to a high-temperature and high-pressure refrigerant and a portion exposed to a low-temperature and low-pressure refrigerant, the air-tight container has a medium temperature between the temperatures of these portions. Furthermore, since current flows in the motor, the motor generates heat. Therefore, the low-temperature and low-pressure refrigerant that has been sucked into the compressor 10 is heated by the air-tight container and the motor in the compressor 10, and is sucked into the compression chamber after the temperature increases (point F in FIG. 5 if suction-injection is not performed).

In the case where suction-injection is performed, the low-temperature and low-pressure gas refrigerant that has passed through an evaporator and the two-phase and low-temperature, suction-injected refrigerant are merged together, and the refrigerant in the two-phase state is sucked into the compressor 10. The two-phase refrigerant is heated and evaporated by the air-tight container and the motor in the compressor 10, turns into the low-temperature and low-pressure gas refrigerant (point H in FIG. 5), which has a temperature lower than the temperature of the case where suction-injection is not performed, and is sucked into the compression chamber. Thus, by performing suction-injection, the discharge temperature of the refrigerant discharged from the compressor 10 is also reduced (point I in FIG. 5), and the discharge temperature is reduced compared to the discharge temperature of the compressor 10 in the case where suction-injection is not performed (point G in FIG. 5).

With the operation described above, in the case where a refrigerant, such as R32, the use of which increases the discharge temperature of the compressor 10, is used, the discharge temperature of the compressor 10 can be reduced, thereby a safety use is ensured.

At this time, the refrigerant in the flow passage in the branch pipe 4*d* from the opening/closing device 24 to the backflow prevention device 20 is a high-pressure refrigerant, and the refrigerant flowing out of the heat medium relay unit 3 via the refrigerant pipe 4, returning to the outdoor unit 1, and reaching the gas-liquid separator 27*b* is a low-pressure refrigerant. The backflow prevention device 20 prevents a refrigerant from flowing from the branch pipe 4*d* to the gas-liquid separator 27*b*. With the operation of the backflow prevention device 20, the high-pressure refrigerant in the branch pipe 4*d* and the low-pressure refrigerant in the gas-liquid separator 27*b* are prevented from mixing together.

Instead of a solenoid valve or the like for which switching between opening and closing can be performed, the opening/closing device 24 may be an electronic expansion valve or the like whose opening area can be changed. The opening/closing device 24 may be of any type as long as it can perform switching between opening and closing of a flow passage. The backflow prevention device 20 may be a check valve or a device that can perform switching between opening and closing of a flow passage, such as a solenoid valve or the like for which switching between opening and closing can be performed or an electronic expansion valve or the like whose opening area can be changed. Since the refrigerant does not flow in the expansion device 14*a*, the opening degree of the expansion device 14*a* may be set to a desired value. Furthermore, an electronic expansion valve or the like whose opening area can be changed is used as the expansion device 14*b*, and the opening area is controlled such that the discharge temperature of the compressor 10 detected by the discharged refrigerant temperature detection device 37 does not become excessively high.

Regarding a way how to perform control, control may be performed such that the opening degree increases by a specific opening degree, for example, by 10 pulses, when the discharge temperature exceeds a specific value, for example, 110 degrees Centigrade. Furthermore, the opening degree of the expansion device 14*b* may be controlled such that the discharge temperature is maintained at a target value, for example, 100 degrees Centigrade. Furthermore, the expansion device 14*b* may be a capillary tube, and injection of the amount of refrigerant corresponding to a pressure difference may be performed.

Next, the flow of the heat medium in the heat medium circuit B will be explained.

In the cooling only operation mode, both the intermediate heat exchanger 15*a* and the intermediate heat exchanger 15*b* transmit the cooling energy of the heat-source-side refrigerant to the heat medium, and the pump 21*a* and the pump 21*b* allow the cooled heat medium to flow through the pipes 5. The heat medium that have been pressurized by and flowed out of the pump 21*a* and the pump 21*b* passes through the second heat medium flow switching device 23*a* and the second heat medium flow switching device 23*b*, and flows into the use-side heat exchanger 26*a* and the use-side heat exchanger 26*b*. When the heat medium receives heat from indoor air by the use-side heat exchanger 26*a* and the use-side heat exchanger 26*b*, cooling of the indoor space 7 is performed.

Then, the heat medium flows out of the use-side heat exchanger 26*a* and the use-side heat exchanger 26*b*, and flows into the heat medium flow control device 25*a* and the heat medium flow control device 25*b*. At this time, the heat medium is flowed into the use-side heat exchanger 26*a* and the use-side heat exchanger 26*b* in such a manner that the flow rate of the heat medium is controlled, with the operation of the heat medium flow control device 25*a* and the heat medium flow control device 25*b*, to a flow rate required for the air conditioning load necessary for inside the room. The heat medium that has flowed out of the heat medium flow control device 25*a* and the heat medium flow control device 25*b* passes through the first heat medium flow switching device 22*a* and the first heat medium flow switching device 22*b*, flows into the intermediate heat exchanger 15*a* and the intermediate heat exchanger 15*b*, and is sucked into the pump 21*a* and the pump 21*b* again.

In the pipes 5 for the use-side heat exchangers 26, the heat medium flows in the direction in which the heat medium from the second heat medium flow switching devices 23 passes through the heat medium flow control devices 25 and flows into the first heat medium flow switching devices 22. Furthermore, the air-conditioning load necessary for the indoor space 7 can be achieved by controlling the difference between the temperature detected by the first temperature sensor 31*a* or the temperature detected by the first temperature sensor 31*b* and the temperature detected by the second temperature sensors 34 to be maintained at a target value. As the exit temperature of the intermediate heat exchangers 15, either the temperature obtained by the first temperature sensor 31*a* or the first temperature sensor 31*b* may be used. Alternatively, the average of these temperatures may be used. At this time, the opening degree of the first heat medium flow switching devices 22 and the second heat medium flow switching devices 23 is set to an intermediate degree so that flow passages to both the intermediate heat exchanger 15*a* and the intermediate heat exchanger 15*b* can be secured.

For execution of the cooling only operation mode, since it is not necessary to flow the heat medium into a use-side heat exchanger 26 in which heat load is not generated (including thermo-off), the flow passage is closed by the corresponding heat medium flow control device 25 so that the heat medium is not flowed into the use-side heat exchanger 26. In FIG. 4, the heat medium flows into the use-side heat exchanger 26*a* and the use-side heat exchanger 26*b* due to the presence of the heat load. However, since no heat load exists in the use-side heat exchanger 26*c* and the use-side heat exchanger 26*d*, the corresponding heat medium flow control device 25*c* and heat medium flow control device 25*d* are fully closed. In the case where heat load is generated in the use-side heat exchanger 26*c* or the use-side heat exchanger 26*d*, the heat medium flow control device 25*c* or the heat medium flow control device 25*d* is to be opened so that the heat medium can circulate.

[Heating Only Operation Mode]

Figure 6:
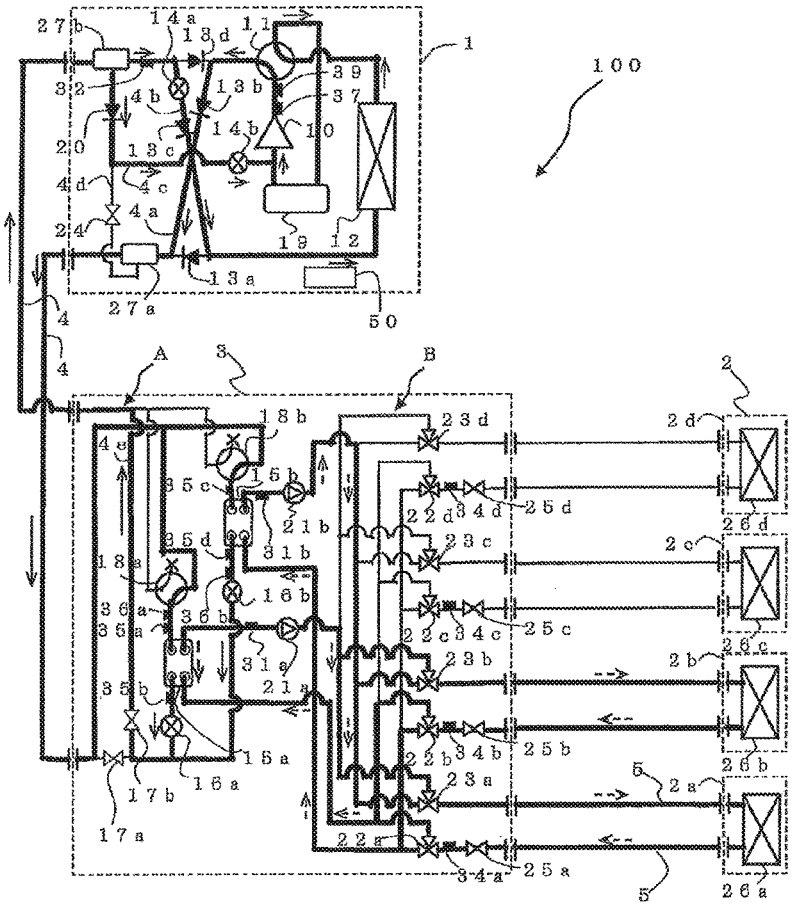
FIG. 6 is a refrigerant circuit diagram illustrating the flow of a refrigerant when the air-conditioning apparatus according to Embodiment 1 of the present invention is in a heating only operation mode.

FIG. 6 is a refrigerant circuit diagram illustrating the flow of the refrigerant when the air-conditioning apparatus 100 is in the heating only operation mode. With reference to FIG. 6, the heating only operation mode will be explained by way of an example of the case where heating load is generated only in the use-side heat exchanger 26*a* and the use-side heat exchanger 26*b*. In FIG. 6, pipes expressed by thick lines represent pipes through which the refrigerants (heat-source-side refrigerant and heat medium) flow. Furthermore, in FIG. 6, the direction of the flow of the heat-source-side refrigerant is expressed by solid-line arrows, and the direction of the flow of the heat medium is expressed by broken-line arrows.

In the case of the heating only operation mode illustrated in FIG. 6, the outdoor unit 1 performs switching of the first refrigerant flow switching device 11 such that the heat-source-side refrigerant discharged from the compressor 10 flows into the heat medium relay unit 3 without passing through the heat-source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between each of the intermediate heat exchanger 15*a* and the intermediate heat exchanger 15*b* and the use-side heat exchanger 26*a* and between each of the intermediate heat exchanger 15*a* and the intermediate heat exchanger 15*b* and the use-side heat exchanger 26*b*.

First, the flow of a heat-source-side refrigerant in the refrigerant circuit A will be explained.

A low-temperature and low-pressure refrigerant is compressed by the compressor 10, and is discharged as a high-temperature and high-pressure gas refrigerant. The high-temperature and high-pressure gas refrigerant discharged from the compressor 10 passes through the first refrigerant flow switching device 11, flows through the first connecting pipe 4*a*, passes through the check valve 13*b* and the gas-liquid separator 27*a*, and is flowed out of the outdoor unit 1. The high-temperature and high-pressure gas refrigerant that has flowed out of the outdoor unit 1 passes through the refrigerant pipe 4 and flows into the heat medium relay unit 3. The high-temperature and high-pressure gas refrigerant that has flowed into the heat medium relay unit 3 is split out, and the split flows of gas refrigerant pass through the second refrigerant flow switching device 18*a* and the second refrigerant flow switching device 18*b* and flow into the intermediate heat exchanger 15*a* and the intermediate heat exchanger 15*b*.

The high-temperature and high-pressure gas refrigerant that has flowed into the intermediate heat exchanger 15*a* and the intermediate heat exchanger 15*b* is condensed and liquefied into high-pressure liquid refrigerant while transferring heat to the heat medium circulating in the heat medium circuit B. The liquid refrigerant that has flowed out of the heat intermediate heat exchanger 15*a* and the intermediate heat exchanger 15*b* is expanded by the expansion device 16*a* and the expansion device 16*b* and turns into two-phase, intermediate-temperature and medium pressure refrigerant. The two-phase refrigerant passes through the opening/closing device 17*b*, flows out of the heat medium relay unit 3, passes through the refrigerant pipe 4, and flows into the outdoor unit 1 again. The refrigerant that has flowed into the outdoor unit 1 partially flows into the second connecting pipe 4*b* via the gas-liquid separator 27*b* and passes through the expansion device 14*a*, is expanded by the expansion device 14*a* into the two-phase, low-temperature and low-pressure refrigerant, passes through the check valve 13*c*, and flows into the heat-source-side heat exchanger 12 operating as an evaporator.

Then, the refrigerant that has flowed into the heat-source-side heat exchanger 12 receives heat from outdoor air by the heat-source-side heat exchanger 12 and turns into the low-temperature and low-pressure gas refrigerant. The low-temperature and low-pressure gas refrigerant that has flowed out of the heat-source-side heat exchanger 12 passes through the first refrigerant flow switching device 11 and the accumulator 19, and is sucked into the compressor 10 again.

At this time, the opening degree of the expansion device 16*a* is controlled such that the subcool (degree of subcooling) obtained as the difference between the value obtained by converting the pressure detected by the pressure sensor 36 into a saturation temperature and the temperature detected by the third temperature sensor 35*b* is maintained constant. Similarly, the opening degree of the expansion device 16*b* is controlled such that the subcool obtained as the difference between the value obtained by converting the pressure detected by the pressure sensor 36 into a saturation temperature and the temperature detected by the third temperature sensor 35*d* is maintained constant. The opening/closing device 17*a* is closed, and the opening/closing device 17*b* is opened. In the case where the temperature of the intermediate position of the intermediate heat exchangers 15 can be measured, the temperature at the intermediate position may be used instead of the pressure sensor 36. In this case, an inexpensive system configuration can be achieved.

Figure 7:
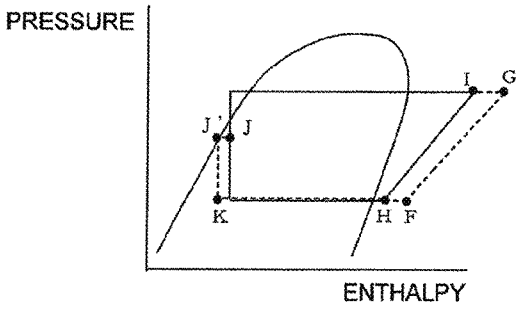
FIG. 7 is a p-h diagram (pressure-enthalpy diagram) illustrating the transition of the state of a heat-source-side refrigerant when the air-conditioning apparatus according to Embodiment 1 of the present invention is in a heating only operation mode.

In the case of a refrigerant such as R32, since the discharge temperature of the compressor 10 is high, the discharge temperature is reduced by using a suction-injection circuit. An operation performed at this time will be explained with reference to FIG. 6 and a p-h diagram (pressure-enthalpy diagram) in FIG. 7. FIG. 7 is a p-h diagram (pressure-enthalpy diagram) representing the transition of the state of a heat-source-side refrigerant in the heating only operation mode. In FIG. 7, the vertical axis represents pressure and the horizontal axis represents enthalpy.

In the heating only operation mode, the refrigerant that has been sucked into the compressor 10 and compressed by the compressor 10 (point I in FIG. 7) is condensed by the heat medium relay unit 3 and then returns from the heat medium relay unit 3 via the refrigerant pipe 4 to the outdoor unit 1. The refrigerant that has returned to the outdoor unit 1 reaches the gas-liquid separator 27*b*. With the operation of the expansion device 14*a*, the pressure of the refrigerant on the upstream side of the expansion device 14*a* is controlled to a medium pressure state (point J in FIG. 7). The two-phase refrigerant that has been controlled to the medium pressure state by the expansion device 14*a* is separated by the gas-liquid separator 27*b* into the liquid refrigerant and a two-phase refrigerant. Then, the separated liquid refrigerant (saturated liquid refrigerant, point J' in FIG. 7) is distributed and flowed into the branch pipe 4*d*. The liquid refrigerant that has been distributed to the branch pipe 4*d* flows into the suction-injection pipe 4*c* via the backflow prevention device 20. The liquid refrigerant is decompressed by the expansion device 14*b* into the two-phase, low-temperature and low-pressure refrigerant (point K in FIG. 7), and is suction-injected into the flow passage between the compressor 10 and the accumulator 19.

In the case where the compressor 10 is of a low-pressure shell type, the temperature of the air-tight container is a medium temperature, as described above. Therefore, a low-temperature and low-pressure refrigerant that has been sucked into the compressor 10 is heated by the air-tight container and the motor in the compressor 10, and is sucked into the compression chamber after the temperature increases (point F in FIG. 7 if suction-injection is not performed).

In the case where suction-injection is performed, the low-temperature and low-pressure gas refrigerant that has passed through the evaporator and the two-phase and low-temperature, suction-injected refrigerant are merged together, and the refrigerant in the two-phase state is sucked into the compressor 10. The two-phase refrigerant is heated and evaporated by the air-tight container and the motor in the compressor 10, turns into the low-temperature and low-pressure gas refrigerant (point H in FIG. 7), which has a temperature lower than the temperature of the case where suction-injection is not performed, and is sucked into the compression chamber. Thus, by performing suction-injection, the discharge temperature of the refrigerant discharged from the compressor 10 is also reduced (point I in FIG. 7), and the discharge temperature is reduced compared to the discharge temperature of the compressor 10 in the case where suction-injection is not performed (point G in FIG. 7).

With the operation described above, in the case where a refrigerant, such as R32, the use of which increases the discharge temperature of the compressor 10, is used, the discharge temperature of the compressor 10 can be reduced, thereby a safety use is ensured, similar to the time of the cooling only operation mode.

At this time, the opening/closing device 24 is closed, which prevents the refrigerant in the high-pressure state from the gas-liquid separator 27*a* from being mixed with the refrigerant in the medium pressure state that has passed through the backflow prevention device 20. The configuration of the opening/closing device 24 and the backflow prevention device 20 are similar to that explained for the cooling only operation mode. Furthermore, the configuration and control method of the expansion device 14*b* are also similar to those explained for the cooling only operation mode.

Furthermore, preferably, an electronic expansion valve or the like whose opening area can be changed is used as the expansion device 14*a*. With the use of an electronic expansion valve, the medium pressure on the upstream side of the expansion device 14*a* can be controlled to a desired pressure. For example, by controlling the opening degree of the expansion device 14*a* such that the medium pressure detected by the medium pressure detection device 32 is maintained constant, a stable control of the discharge temperature by the expansion device 14*b* is ensured. However, the expansion device 14*a* is not limited thereto. It may be possible, with a combination of opening/closing valves such as compact solenoid valves, to perform selection between a plurality of opening areas. Alternatively, medium pressure may be formed in accordance with pressure loss of the refrigerant by using a capillary tube as the expansion device 14*a*. In this case, although controllability is slightly degraded, the discharge temperature can be controlled to a target value. Furthermore, the medium pressure detection device 32 may be a pressure sensor. Alternatively, medium pressure may be obtained by calculation using a temperature sensor.

In the heating only operation mode, since both the intermediate heat exchanger 15*a* and the intermediate heat exchanger 15*b* heat the heat medium, the pressure (medium pressure) of the refrigerant on the upstream side of the expansion device 14*a* may be controlled to be slightly high as long as the pressure falls within a range in which the expansion device 16*a* and the expansion device 16*b* can control subcool. By controlling the medium pressure to be slightly high, its pressure difference from the pressure inside the compression chamber becomes larger, thereby a large suction-injection flow rate can be ensured. Thus, even in the case where the outdoor air temperature is low, a suction-injection flow rate sufficient for reducing the discharge temperature can be ensured.

Furthermore, the expansion device 14*a* and the expansion device 14*b* are not necessarily controlled in the way described above. The expansion device 14*a* and the expansion device 14*b* may be controlled in such a way that the expansion device 14*b* is fully opened and the discharge temperature of the compressor 10 is controlled by the expansion device 14*a*. With this way, control can be simplified, and an inexpensive device can be advantageously used as the expansion device 14*b*.

Next, the flow of the heat medium in the heat medium circuit B will be explained.

In the heating only operation mode, both the intermediate heat exchanger 15*a* and the intermediate heat exchanger 15*b* transmit the heating energy of heat-source-side refrigerant to heat medium, and the pump 21*a* and the pump 21*b* allow the heated heat medium to flow through the pipes 5. The heat medium that have been pressurized by and flowed out of the pump 21*a* and the 21*b* pass through the second heat medium flow switching device 23*a* and the second heat medium flow switching device 23*b*, and flow into the use-side heat exchanger 26*a* and the use-side heat exchanger 26*b*. Then, when the flows of the heat medium transfer heat to indoor air by the use-side heat exchanger 26*a* and the use-side heat exchanger 26*b*, heating of the indoor space 7 is performed.

Then, the flows of the heat medium flow out of the use-side heat exchanger 26*a* and the use-side heat exchanger 26*b*, and flow into the heat medium flow control device 25*a* and the heat medium flow control device 25*b*. At this time, the flows of the heat medium are flowed into the use-side heat exchanger 26*a* and the use-side heat exchanger 26*b* in such a manner that the flow rate of the heat medium is controlled, with the operation of the heat medium flow control devices 25*a* and 25*b*, to a flow rate required for the air-conditioning load necessary for inside the room. The heat medium that has flowed out of the heat medium flow control device 25*a* and the heat medium flow control device 25*b* passes through the first heat medium flow switching device 22*a* and the first heat medium flow switching device 22*b*, flows into the intermediate heat exchanger 15*a* and the intermediate heat exchanger 15*b*, and is sucked into the pump 21*a* and the pump 21*b* again.

In the pipes 5 for the use-side heat exchangers 26, the heat medium flows in the direction in which the heat medium from the second heat medium flow switching devices 23 passes through the heat medium flow control devices 25 and flows into the first heat medium flow switching devices 22. Furthermore, the air-conditioning load necessary for the indoor space 7 can be achieved by controlling the difference between the temperature detected by the first temperature sensor 31*a* or the temperature detected by the first temperature sensor 31*b* and the temperature detected by the second temperature sensors 34 to be maintained at a target value. As the exit temperature of the intermediate heat exchangers 15, either the temperature obtained by the first temperature sensor 31*a* or the first temperature sensor 31*b* may be used. Alternatively, the average of these temperatures may be used.

At this time, the opening degree of the first heat medium flow switching devices 22 and the second heat medium flow switching devices 23 is set to an intermediate degree so that flows to both the intermediate heat exchanger 15*a* and the intermediate heat exchanger 15*b* can be secured. Originally, the use-side heat exchanger 26*a* should be controlled on the basis of the difference between the temperature of the entry and exit thereof. However, since the heat medium temperature on the entry side of the use-side heat exchanger 26 is almost the same as the temperature detected by the first temperature sensor 31*b*, using the first temperature sensor 31*b* reduces the number of temperature sensors. Accordingly, an inexpensive system configuration can be achieved. Similar to the cooling only operation mode, the opening degree of the heat medium flow control devices 25 may be controlled in accordance with the presence or absence of the heat load in the use-side heat exchangers 26.

[Cooling Main Operation Mode]

Figure 8:
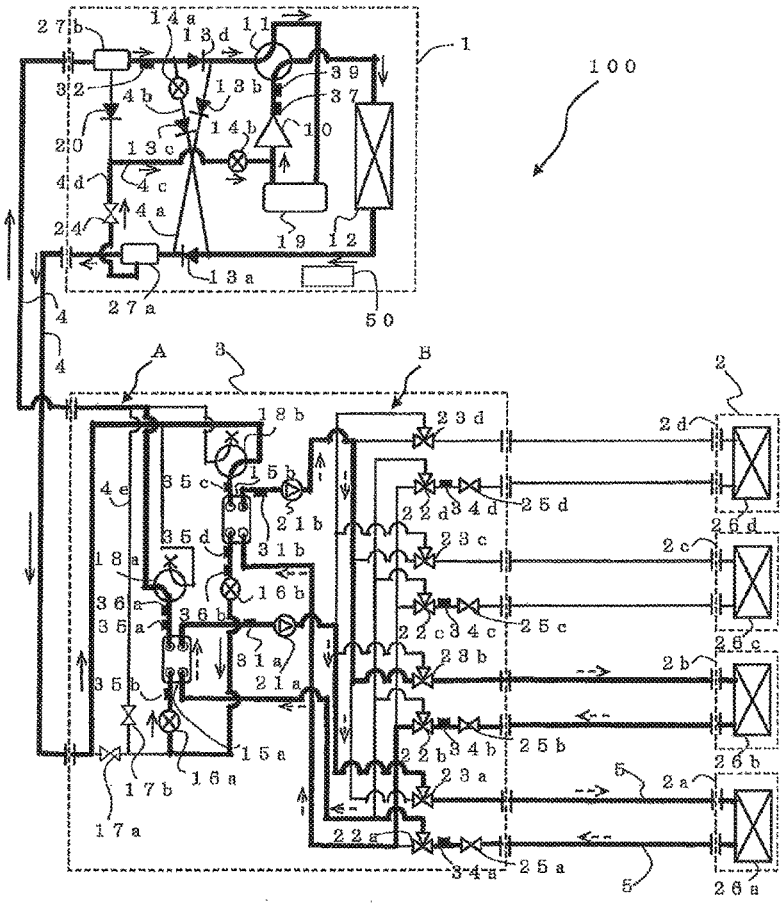
FIG. 8 is a refrigerant circuit diagram illustrating the flow of a refrigerant when the air-conditioning apparatus according to Embodiment 1 of the present invention is in a cooling main operation mode.

FIG. 8 is a refrigerant circuit diagram illustrating the flow of the refrigerant when the air-conditioning apparatus 100 is in the cooling main operation mode. With reference to FIG. 8, the cooling main operation mode will be explained by way of an example of the case where the cooling load is generated in the use-side heat exchanger 26*a* and the heating load is generated in the use-side heat exchanger 26*b*. In FIG. 8, pipes expressed by thick lines represent pipes through which the refrigerants (heat-source-side refrigerant and heat medium) circulate. Furthermore, in FIG. 8, the direction of the flow of the heat-source-side refrigerant is expressed by solid-line arrows, and the direction of the flow of the heat medium is expressed by broken-line arrows.

In the case of the cooling main operation mode illustrated in FIG. 8, the outdoor unit 1 performs switching of the first refrigerant flow switching device 11 in such a manner that the heat-source-side refrigerant discharged from the compressor 10 is flowed into the heat-source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between the intermediate heat exchanger 15*a* and the use-side heat exchanger 26*a* and between the intermediate heat exchanger 15*b* and the use-side heat exchanger 26*b*.

First, the flow of a heat-source-side refrigerant in the refrigerant circuit A will be explained.

A low-temperature and low-pressure refrigerant is compressed by the compressor 10, and is discharged as a high-temperature and high-pressure gas refrigerant. The high-temperature and high-pressure gas refrigerant discharged from the compressor 10 passes through the first refrigerant flow switching device 11, and flows into the heat-source-side heat exchanger 12. Then, the gas refrigerant is condensed into the two-phase refrigerant while transferring heat to outdoor air by the heat-source-side heat exchanger 12. The two-phase refrigerant that has flowed out of the heat-source-side heat exchanger 12 passes through the check valve 13*a*, partially flows out of the outdoor unit 1 via the gas-liquid separator 27*a*, passes through the refrigerant pipe 4, and flows into the heat medium relay unit 3. The two-phase refrigerant that has flowed into the heat medium relay unit 3 passes through the second refrigerant flow switching device 18*b*, and flows into the intermediate heat exchanger 15*b* operating as a condenser.

The two-phase refrigerant that has flowed into the intermediate heat exchanger 15*b* is condensed and liquefied into the liquid refrigerant while transferring heat to the heat medium circulating in the heat medium circuit B. The liquid refrigerant that has flowed out of the intermediate heat exchanger 15*b* is expanded by the expansion device 16*b* into the two-phase, low-pressure refrigerant. The two-phase, low-pressure refrigerant passes through the expansion device 16*a*, and flows into the intermediate heat exchanger 15*a* operating as an evaporator. The two-phase, low-pressure refrigerant that has flowed into the intermediate heat exchanger 15*a* turns into the low-pressure gas refrigerant while cooling the heat medium by receiving heat from the heat medium circulating in the heat medium circuit B. The gas refrigerant flows out of the intermediate heat exchanger 15*a*, passes through the second refrigerant flow switching device 18*a*, flows out of the heat medium relay unit 3, passes through the refrigerant pipe 4, and flows into the outdoor unit 1 again. The refrigerant that has flowed into the outdoor unit 1 passes through the gas-liquid separator 27*a*, the check valve 13*d*, the first refrigerant flow switching device 11, and the accumulator 19, and is sucked into the compressor 10 again.

At this time, the opening degree of the expansion device 16*b* is controlled such that the superheat obtained as the difference between the temperature detected by the third temperature sensor 35*a* and the temperature detected by the third temperature sensor 35*b* is maintained constant. Furthermore, the expansion device 16*a* is fully opened, the opening/closing device 17*a* is closed, and the opening/closing device 17*b* is closed. Here, the opening degree of the expansion device 16*b* may be controlled such that the subcool obtained as the difference between the value obtained by converting the pressure detected by the pressure sensor 36 into a saturation temperature and the temperature detected by the third temperature sensor 35*d* is maintained constant. Furthermore, the expansion device 16*b* may be fully opened, and the superheat or the subcool may be controlled using the expansion device 16*a*.

Figure 9:
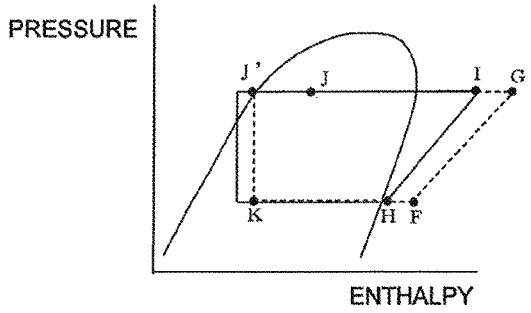
FIG. 9 is a p-h diagram (pressure-enthalpy diagram) illustrating the transition of the state of a heat-source-side refrigerant when the air-conditioning apparatus according to Embodiment 1 of the present invention is in a cooling main operation mode.

In the case of a refrigerant such as R32, since the discharge temperature of the compressor 10 is high, the discharge temperature is reduced by using a suction-injection circuit. An operation performed at this time will be explained with reference to FIG. 8 and a p-h diagram (pressure-enthalpy diagram) in FIG. 9. FIG. 9 is a p-h diagram (pressure-enthalpy diagram) representing the transition of the state of a heat-source-side refrigerant in the cooling main operation mode. In FIG. 9, the vertical axis represents pressure and the horizontal axis represents enthalpy.

In the cooling main operation mode, the refrigerant that has been compressed by the compressor 10 is condensed by the heat-source-side heat exchanger 12 into the two-phase, high-pressure refrigerant (point J in FIG. 9), and reaches the gas-liquid separator 27*a* via the check valve 13*a*. The opening/closing device 24 is opened, and the two-phase, high-pressure refrigerant is separated by the gas-liquid separator 27*a* into the liquid refrigerant and a two-phase refrigerant. The separated liquid refrigerant (saturated liquid refrigerant, point J' in FIG. 9) is distributed to the opening/closing device 24 and the branch pipe 4*d*. The liquid refrigerant distributed to the branch pipe 4*d* flows into the suction-injection pipe 4*c*, is decompressed by the expansion device 14*b* into the two-phase, low-temperature and low-pressure refrigerant (point Kin FIG. 9). Then, the two-phase, low-temperature and low-pressure refrigerant flows into the flow passage between the compressor 10 and the accumulator 19.

In the case where the compressor 10 is of a low-pressure shell type, the temperature of the air-tight container is a medium temperature, as described above. Therefore, a low-temperature and low-pressure refrigerant that has been sucked into the compressor 10 is heated by the air-tight container and the motor in the compressor 10, and is sucked into the compression chamber after the temperature increases (point F in FIG. 9 if suction-injection is not performed).

In the case where suction-injection is performed, the low-temperature and low-pressure gas refrigerant that has passed through the evaporator and the two-phase and low-temperature, suction-injected refrigerant are merged together, and the refrigerant in the two-phase state is sucked into the compressor 10. The two-phase refrigerant is heated and evaporated by the air-tight container and the motor in the compressor 10, turns into the low-temperature and low-pressure gas refrigerant (point H in FIG. 9), which has a temperature lower than the temperature of the case where suction-injection is not performed, and is sucked into the compression chamber. Thus, by performing suction-injection, the discharge temperature of the refrigerant discharged from the compressor 10 is also reduced (point I in FIG. 9), and the discharge temperature is reduced compared to the discharge temperature of the compressor 10 in the case where suction-injection is not performed (point G in FIG. 9).

With the operation described above, in the case where a refrigerant, such as R32, the use of which increases the discharge temperature of the compressor 10, is used, the discharge temperature of the compressor 10 can be reduced, thereby a safety use is ensured, similar to the cooling only operation mode.

The configuration and operation of the opening/closing device 24, the backflow prevention device 20, the expansion device 14*a*, and the expansion device 14*b* are similar to those explained for the cooling only operation mode.

Next, the flow of the heat medium in the heat medium circuit B will be explained.

In the cooling main operation mode, the intermediate heat exchanger 15*b* transmits the heating energy of a heat-source-side refrigerant to the heat medium, and the pump 21*b* allows the heated heat medium to flow through the pipes 5. Furthermore, in the cooling main operation mode, the intermediate heat exchanger 15*a* transmits the cooling energy of the heat-source-side refrigerant to the heat medium, and the pump 21*a* allows the cooled heat medium to flow through the pipes 5. The heat medium that has been pressurized by and flowed out of the pump 21*a* and the pump 21*b* passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, when the heat medium transfers heat to indoor air, heating of the indoor space 7 is performed. Furthermore, in the use-side heat exchanger 26*a*, when the heat medium receives heat from indoor air, cooling of the indoor space 7 is performed. At this time, the heat medium is flowed into the use-side heat exchanger 26*a* and the use-side heat exchanger 26*b* in such a manner that the flow rate of the heat medium is controlled, with the operation of the heat medium flow control device 25*a* and the heat medium flow control device 25*b*, to be a flow rate required for the air-conditioning load necessary for inside the room. The heat medium that has passed through the use-side heat exchanger 26*b* and whose temperature has been slightly reduced passes through the heat medium flow control device 25*b* and the first heat medium flow switching device 22*b*, flows into the intermediate heat exchanger 15*b*, and is sucked into the pump 21*b* again. The heat medium that has passed through the use-side heat exchanger 26*a* and whose temperature has been slightly increased passes through the heat medium flow control device 25*a* and the first heat medium flow switching device 22*a*, flows into the intermediate heat exchanger 15*a*, and is sucked into the pump 21*a* again.

During this processing, with the operation of the first heat medium flow switching devices 22 and the second heat medium flow switching devices 23, the warm heat medium and the cold heat medium do not mix together and are individually introduced into the corresponding use-side heat exchangers 26 in which the heating load and the cooling load are generated. Here, in the pipes 5 for the use-side heat exchangers 26, the heat medium flows in the direction, for both the heating side and the cooling side, in which the heat medium from the second heat medium flow switching devices 23 passes through the heat medium flow control devices 25 and reaches the first heat medium flow switching devices 22. Furthermore, the air-conditioning load necessary for the indoor space 7 can be achieved by, for the heating side, controlling the difference between the temperature detected by the first temperature sensor 31*b* and the temperature detected by the corresponding second temperature sensor 34 to be maintained at a target value and, for the cooling side, controlling the difference between the temperature detected by the corresponding second temperature sensor 34 and the temperature detected by the first temperature sensor 31*a* to be maintained at a target value.

As in the cooling only operation mode and the heating only operation mode, the opening degree of the heat medium flow control devices 25 is controlled in accordance with the presence or absence of heat load in the use-side heat exchangers 26.

[Heating Main Operation Mode]

Figure 10:
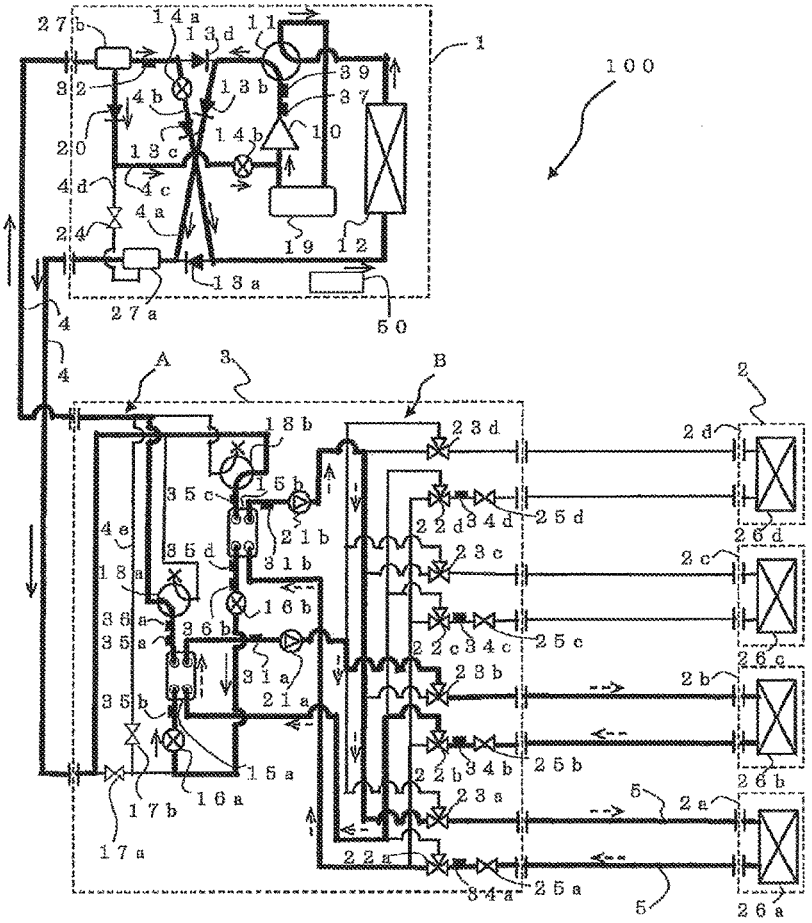
FIG. 10 is a refrigerant circuit diagram illustrating the flow of a refrigerant when the air-conditioning apparatus according to Embodiment 1 of the present invention is in a heating main operation mode.

FIG. 10 is a refrigerant circuit diagram illustrating the flow of the refrigerant when the air-conditioning apparatus 100 is in the heating main operation mode. With reference to FIG. 10, the heating main operation mode will be explained by way of an example of the case where heating load is generated in the use-side heat exchanger 26*a* and cooling load is generated in the use-side heat exchanger 26*b*. In FIG. 10, pipes expressed by thick lines represent pipes through which the refrigerants (heat-source-side refrigerant and heat medium) circulate. Furthermore, in FIG. 10, the direction of the flow of the heat-source-side refrigerant is expressed by solid-line arrows, and the direction of the flow of the heat medium is expressed by broken-line arrows.

In the case of the heating main operation mode illustrated in FIG. 10, the outdoor unit 1 performs switching of the first refrigerant flow switching device 11 in such a manner that a heat-source-side refrigerant discharged from the compressor 10 is flowed into the heat medium relay unit 3 without causing the heat-source-side refrigerant to pass through the heat-source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between the intermediate heat exchanger 15*a* and the use-side heat exchanger 26*b* and between the intermediate heat exchanger 15*b* and the use-side heat exchanger 26*a*.

First, the flow of a refrigerant in the refrigerant circuit A will be explained.

A low-temperature and low-pressure refrigerant is compressed by the compressor 10, and is discharged as a high-temperature and high-pressure gas refrigerant. The high-temperature and high-pressure gas refrigerant discharged from the compressor 10 passes through the first refrigerant flow switching device 11, the first connecting pipe 4*a*, and the check valve 13*b*, and flows out of the outdoor unit 1 via the gas-liquid separator 27*a*. The high-temperature and high-pressure gas refrigerant that has flowed out of the outdoor unit 1 passes through the refrigerant pipe 4, and flows into the heat medium relay unit 3. The high-temperature and high-pressured gas refrigerant that has flowed into the heat medium relay unit 3 passes through the second refrigerant flow switching device 18*b*, and flows into the intermediate heat exchanger 15*b* operating as a condenser.

The gas refrigerant that has flowed into the intermediate heat exchanger 15*b* is condensed and liquefied into the liquid refrigerant while transferring heat to the heat medium circulating in the heat medium circuit B. The liquid refrigerant that has flowed out of the intermediate heat exchanger 15*b* is expanded by the expansion device 16*b* and turns into the two-phase, medium pressure refrigerant. The two-phase, medium pressure refrigerant passes through the expansion device 16*a*, and flows into the intermediate heat exchanger 15*a* operating as an evaporator. The two-phase, medium pressure refrigerant that has flowed into the intermediate heat exchanger 15*a* evaporates by receiving heat from the heat medium circulating in the heat medium circuit B, and thus cools the heat medium. The two-phase, medium pressure refrigerant flows out of the intermediate heat exchanger 15*a*, passes through the second refrigerant flow switching device 18*a*, flows out of the heat medium relay unit 3, and flows through the refrigerant pipe 4 into the outdoor unit 1 again.

The refrigerant that has flowed into the outdoor unit 1 partially flows into the second connecting pipe 4*b* via the gas-liquid separator 27*b*, passes through the expansion device 14*a*, is expanded by the expansion device 14*a* into the two-phase, low-temperature and low-pressure refrigerant, passes through the check valve 13*c*, and flows into the heat-source-side heat exchanger 12 operating as an evaporator. Then, the refrigerant that has flowed into the heat-source-side heat exchanger 12 receives heat from outdoor air by the heat-source-side heat exchanger 12, and thus turns into the low-temperature and low-pressure gas refrigerant. The low-temperature and low-pressure gas refrigerant that has flowed out of the heat-source-side heat exchanger 12 passes through the first refrigerant flow switching device 11 and the accumulator 19, and is sucked into the compressor 10 again.

At this time, the opening degree of the expansion device 16*b* is controlled such that the subcool obtained as the difference between the value obtained by converting the pressure detected by the pressure sensor 36 into a saturation temperature and the temperature detected by the third temperature sensor 35*b* is maintained constant. Furthermore, the expansion device 16*a* is fully opened, the opening/closing device 17*a* is closed, and the opening/closing device 17*b* is closed. Here, the expansion device 16*b* may be fully opened, and the subcool may be controlled using the expansion device 16*a*.

Figure 11:
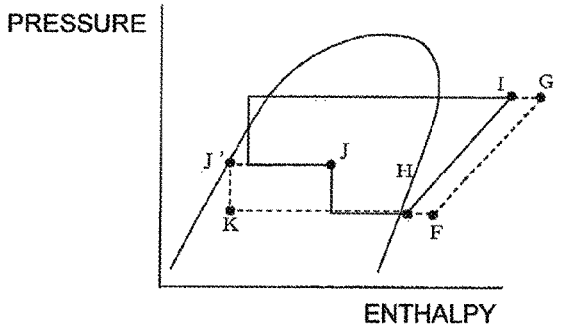
FIG. 11 is a p-h diagram (pressure-enthalpy diagram) illustrating the transition of the state of a heat-source-side refrigerant when the air-conditioning apparatus according to Embodiment 1 of the present invention is in a heating main operation mode.

In the case of a refrigerant such as R32, since the discharge temperature of the compressor 10 is high, the discharge temperature is reduced by using a suction-injection circuit. An operation performed at this time will be explained with reference to FIG. 10 and a p-h diagram (pressure-enthalpy diagram) in FIG. 11. FIG. 11 is a p-h diagram (pressure-enthalpy diagram) representing the transition of the state of a heat-source-side refrigerant in the heating main operation mode. In FIG. 11, the vertical axis represents pressure and the horizontal axis represents enthalpy.

In the heating main operation mode, the refrigerant returns from the heat medium relay unit 3 via the refrigerant pipe 4 to the outdoor unit 1. The refrigerant that has returned to the outdoor unit 1 reaches the gas-liquid separator 27*b*. With the operation of the expansion device 14*a*, the pressure of the refrigerant on the upstream side of the expansion device 14*a* is controlled to a medium pressure state (point J in FIG. 11). The two-phase refrigerant that has been controlled to the medium pressure state by the expansion device 14*a* is separated by the gas-liquid separator 27*b* into the liquid refrigerant and the two-phase refrigerant. Then, the separated liquid refrigerant (saturated liquid refrigerant, point J' in FIG. 11) is distributed and flowed into the branch pipe 4*d*. The liquid refrigerant that has been distributed to the branch pipe 4*d* flows into the suction-injection pipe 4*c* via the backflow prevention device 20, is decompressed by the expansion device 14*b* into the two-phase, low-temperature and low-pressure refrigerant (point K in FIG. 11), and is flowed into the flow passage between the compressor 10 and the accumulator 19.

In the case where the compressor 10 is of a low-pressure shell type, the temperature of the air-tight container is a medium temperature, as described above. Therefore, a low-temperature and low-pressure refrigerant that has been sucked into the compressor 10 is heated by the air-tight container and the motor in the compressor 10, and is sucked into the compression chamber after the temperature increases (point F in FIG. 11 if suction-injection is not performed).

In the case where suction-injection is performed, the low-temperature and low-pressure gas refrigerant that has passed through the evaporator and the two-phase and low-temperature, suction-injected refrigerant are merged together, and the refrigerant in the two-phase state is sucked into the compressor 10. The two-phase refrigerant is heated and evaporated by the air-tight container and the motor in the compressor 10, turns into the low-temperature and low-pressure gas refrigerant (point H in FIG. 11), which has a temperature lower than the temperature of the case where suction-injection is not performed, and is sucked into the compression chamber. Thus, by performing suction-injection, the discharge temperature of the refrigerant discharged from the compressor 10 is also reduced (point I in FIG. 11), and the discharge temperature is reduced compared to the discharge temperature of the compressor 10 in the case where suction-injection is not performed (point G in FIG. 11).

With the operation described above, in the case where a refrigerant, such as R32, the use of which increases the discharge temperature of the compressor 10, is used, the discharge temperature of the compressor 10 can be reduced, thereby a safety use is ensured, similar to the cooling only operation mode.

The configuration and operation of the opening/closing device 24, the backflow prevention device 20, the expansion device 14*a*, and the expansion device 14*b* are similar to those explained for the heating only operation mode. Furthermore, the expansion device 14*a* and the expansion device 14*b* are controlled in a way similar to that explained for the heating only operation mode.

In the heating main operation mode, the heat medium needs to be cooled in the intermediate heat exchanger 15*a*. Therefore, the pressure (medium pressure) of the refrigerant on the upstream side of the expansion device 14*a* cannot be controlled to be very high. Since the medium pressure cannot be controlled to become high, the suction-injection flow rate is small, thus reducing a decrease in the discharge temperature. However, since it is necessary to prevent the heat medium from freezing, when the outdoor air temperature is low, for example, −5 degrees Centigrade or lower, the heating only operation mode is not entered. When the outdoor air temperature is high, since the discharge temperature is not very high and a large injection flow rate is not required, no problem occurs. With the expansion device 14*a*, the heat medium in the intermediate heat exchanger 15*b* can be cooled, and setting to a medium pressure at which an injection flow rate sufficient for reducing the discharge temperature can be supplied to the compression chamber is performed. Therefore, a safety operation can be ensured.

Next, the flow of the heat medium in the heat medium circuit B will be explained.

In the heating main operation mode, the intermediate heat exchanger 15*b* transmits the heating energy of the heat-source-side refrigerant to the heat medium, and the pump 21*b* allows the heated heat medium to flow through the pipes 5. Furthermore, in the heating main operation mode, the intermediate heat exchanger 15*a* transmits the cooling energy of the heat-source-side refrigerant to the heat medium, and the pump 21*a* allows the cooled heat medium to flow through the pipes 5. The heat medium that has been pressurized by and flowed out of the pump 21*a* and the pump 21*b* passes through the second heat medium flow switching device 23*a* and the second heat medium flow switching device 23*b*, and flows into the use-side heat exchanger 26*a* and the use-side heat exchanger 26*b*.

In the use-side heat exchanger 26*b*, when the heat medium receives heat from indoor air, cooling of the indoor space 7 is performed. Furthermore, in the use-side heat exchanger 26*a*, when the heat medium transfers heat to indoor space, heating of the indoor space 7 is performed. At this time, the heat medium is flowed into the use-side heat exchanger 26*a* and the use-side heat exchanger 26*b* in such a manner that the flow rate of the heat medium is controlled, with the operation of the heat medium flow control device 25*a* and the heat medium flow control device 25*b*, to be a flow rate required for the air-conditioning load necessary for inside the room. The heat medium that has passed through the use-side heat exchanger 26*b* and whose temperature has been slightly increased passes through the heat medium flow control device 25*b* and the first heat medium flow switching device 22*b*, flows into the intermediate heat exchanger 15*a*, and is sucked into the pump 21*a* again. The heat medium that has passed through the use-side heat exchanger 26*a* and whose temperature has been slightly reduced passes through the heat medium flow control device 25*a* and the first heat medium flow switching device 22*a*, flows into the intermediate heat exchanger 15*b*, and is sucked into the pump 21*b* again.

During this processing, with the operation of the first heat medium flow switching devices 22 and the second heat medium flow switching devices 23, the warm heat medium and the cold heat medium do not mix together and are individually introduced into the corresponding use-side heat exchangers 26 in which the heating load and the cooling load are generated. Here, in the pipes 5 for the use-side heat exchangers 26, for both the heating side and the cooling side, the heat medium flows in the direction in which the heat medium from the second heat medium flows switching devices 23 passes through the heat medium flow control devices 25 and flows into the first heat medium flow switching devices 22. Furthermore, the air-conditioning load necessary for the indoor space 7 can be achieved by, for the heating side, controlling the difference between the temperature detected by the first temperature sensor 31*b* and the temperature detected by the corresponding second temperature sensor 34 to be maintained at a target value and, for the cooling side, controlling the difference between the temperature detected by the corresponding second temperature sensor 34 and the temperature detected by the first temperature sensor 31*a* to be maintained at a target value.

As in the cooling only operation mode, the heating only operation mode, and the cooling main operation mode, the opening degree of the heat medium flow control devices 25 may be controlled in accordance with the presence or absence of heat load in the use-side heat exchangers 26.

[Expansion Device 14*a* and/or Expansion Device 14*b*]

Suction-injection to the suction side of the compressor 10 in each operation mode is performed as described above. Accordingly, the flows of liquid refrigerant separated by the gas-liquid separator 27*a* and the gas-liquid separator 27*b* flow into the expansion device 14*a* and the expansion device 14*b*. However, in any mode except for the cooling only operation mode, the liquid refrigerant separated by the gas-liquid separator 27*a* and the gas-liquid separator 27*b* is not sub-cooled, and the liquid refrigerant is in the saturated liquid state. In actuality, saturated liquid represents a state in which a small amount of minute refrigerant gas exists. In addition, due to minute pressure loss in the opening/closing device 24, a refrigerant pipe, or the like, the liquid refrigerant may turn into the two-phase refrigerant.

In the case where an electronic expansion valve is used as an expansion device, when the refrigerant in a two-phase state flows into the expansion device, if a gas refrigerant and a liquid refrigerant flow separately, the state in which gas flows into the expansion part and the state in which liquid flows into the expansion part may occur individually. In this case, the pressure on the exit side of the expansion device may be unstable. In particular, when the quality is low, refrigerant separation occurs, and this tendency is highly likely to occur. Under such a situation, by using the expansion device 14*a* and/or the expansion device 14*b* having the configuration illustrated in FIG. 12, a stable control can be ensured even if a two-phase refrigerant flows into the expansion device 14*a* and/or the expansion device 14*b*. In the case where a gas-liquid separator is used, a sufficiently stable control can be achieved without providing such a configuration on the expansion device. However, with the use of the expansion device having the configuration illustrated in FIG. 12, a further stable control can be ensured, regardless of environmental conditions.

Figure 12:
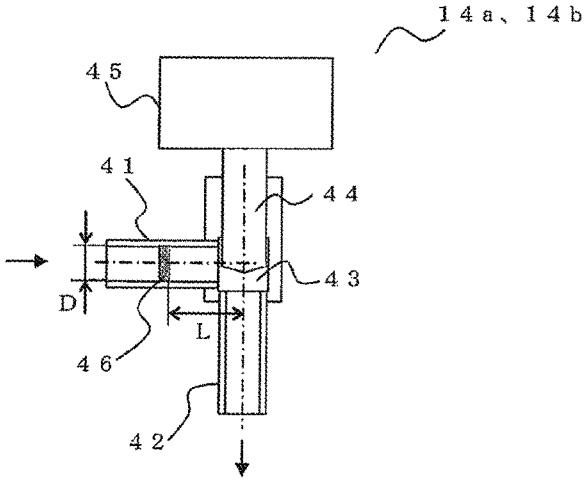
FIG. 12 is a schematic diagram illustration an example of the configuration of an expansion device.

FIG. 12 is a schematic diagram illustrating an example of the configuration of the expansion device 14*a* and/or the expansion device 14*b*. An example of the expansion device 14*a* and/or the expansion device 14*b* will be explained with reference to FIG. 12. In the explanation provided below, the expansion device 14*a* and/or the expansion device 14*b* may be simply referred to as an expansion device 14.

Referring to FIG. 12, the expansion device 14 includes an inflow pipe 41, an outflow pipe 42, an expansion part 43, a valve body 44, a motor 45, and a mixing device 46. The mixing device 46 is mounted within the inflow pipe 41. A two-phase refrigerant flowing in from the inflow pipe 41 reaches the mixing device 46. With the operation of the mixing device 46, the gas refrigerant and the liquid refrigerant are agitated and mixed substantially uniformly. The two-phase refrigerant containing the gas refrigerant and the liquid refrigerant that have been mixed substantially uniformly is expanded by the valve body 44 in the expansion part 43, is decompressed, and flows out of the outflow pipe 42. At this time, the position of the valve body 44 is controlled by the motor 45, so that the expansion amount by the expansion part 43 is controlled.

The mixing device 46 may be of any type as long as it is capable of generating a state in which the gas refrigerant and the liquid refrigerant mix together substantially uniformly. For example, this state can be achieved by using foam metal. Foam metal is a metal porous body having the same three-dimensional net-like structure as a resin foam body, such as a sponge, and has the maximum (between 80% and 97%) porosity (void) of all the types of metal porous body. Circulation of a two-phase refrigerant through such foam metal achieves an advantage of finely cutting gas in the refrigerant, agitating the gas, and mixing the gas with the liquid uniformly, due to the three-dimensional net-like structure.

In the field of fluid mechanics, it is clear that when a refrigerant inside a pipe travels from a portion having a structure disturbing the flow to a portion in which L/D reaches between 8 and 10, where D represents the inner diameter of the pipe and L represents the length of the pipe, the influence of the disturbance disappears and the original flow is recovered. In the case where the mixing device 46 is arranged at a position where L/D is 6 or less, where D represents the inner diameter of the inflow pipe 41 of the expansion device 14 and L represents the length from the mixing device 46 to the expansion part 43, the mixed two-phase refrigerant maintained in the mixed state can reach the expansion part 43, thus a stable control is ensured.

Furthermore, the state of a high discharge temperature occurs in the case where the frequency of the compressor 10 increases and the condensing temperature increases in order to maintain the evaporating temperature at a target temperature, for example, zero degrees Centigrade during a cooling operation when the outdoor air temperature is high. Alternatively, the state of a high discharge temperature occurs in the case where the frequency of the compressor 10 increases and the evaporating temperature decreases in order to maintain the condensing temperature at a target temperature, for example, 49 degrees Centigrade during a heating operation when the outdoor air temperature is low. At the time of a cooling main operation, the condensing temperature and the evaporating temperature need to be maintained at corresponding target temperatures, for example, 49 degrees Centigrade and zero degrees Centigrade, respectively. In the case of a cooling main operation when the outdoor air temperature is high, since the condensing temperature and the evaporating temperature are higher than the corresponding target temperatures, the state in which the frequency of the compressor 10 becomes very high is not likely to occur, unlike a cooling operation when the outdoor air temperature is high, and increasing the frequency of the compressor 10 is limited in order not to cause the condensing temperature to become excessively high.

Figure 13:
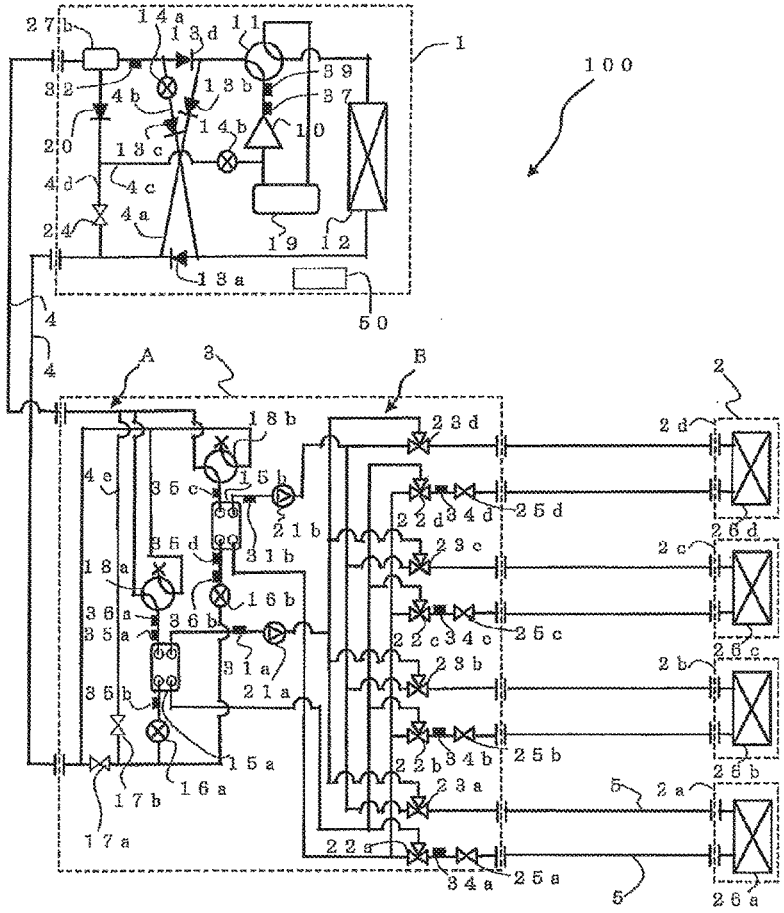
FIG. 13 is a schematic circuit configuration diagram illustrating an example of a modification of the circuit configuration of the air-conditioning apparatus according to Embodiment 1 of the present invention.

Thus, in the cooling main operation mode, the discharge temperature is less likely to become high. Because of this, as illustrated in FIG. 13, by eliminating the gas-liquid separator 27*a* and providing a branching unit that splits the refrigerant, the opening/closing device 24 may be closed at the time of a cooling main operation, and suction-injection may not be performed. FIG. 13 is a schematic circuit configuration diagram illustrating an example in which the circuit configuration of the air-conditioning apparatus 100 according to Embodiment 1 of the present invention is modified.

[Refrigerant Pipes 4]

As described above, the air-conditioning apparatus 100 according to this embodiment have some operation modes. In these operation modes, the heat-source-side refrigerant flows in refrigerant pipes 4, which connect the outdoor unit 1 with the heat medium relay unit 3.

[Pipes 5]

In some operation modes executed by the air-conditioning apparatus 100 according to this embodiment, the heat medium, such as water, antifreeze, or the like, flow in the pipes 5, which connect the heat medium relay unit 3 with the indoor units 2.

The case in which the pressure sensor 36*a* is arranged at the flow passage between the intermediate heat exchanger 15*a* and the second refrigerant flow switching device 18*a* that operate as a cooling side in a cooling and heating mixed operation and the pressure sensor 36*b* is arranged at the flow passage between the intermediate heat exchanger 15*b* and the expansion device 16*b* that operate as a heating side in a cooling and heating mixed operation has been described above. With this arrangement, even if pressure loss occurs in the intermediate heat exchanger 15*a* and the intermediate heat exchanger 15*b*, the saturation temperature can be accurately calculated.

However, since pressure loss on the condensing side is small, the pressure sensor 36*b* may be arranged at the flow passage between the intermediate heat exchanger 15*b* and the expansion device 16*b*. Even in this case, the accuracy in calculation is not very degraded. Furthermore, although pressure loss in an evaporator is relatively large, in the case where an intermediate heat exchanger whose pressure loss can be estimated or whose pressure loss is small is used, the pressure sensor 36*a* may be arranged at the flow passage between the intermediate heat exchanger 15*a* and the second refrigerant flow switching device 18*a*.

In the case where only heating load or cooling load is generated in a use-side heat exchanger 26, the air-conditioning apparatus 100 sets the opening degree of a corresponding first heat medium flow switching device 22 and a corresponding second heat medium flow switching device 23 to an intermediate degree so that the heat medium flows to both the intermediate heat exchanger 15*a* and the intermediate heat exchanger 15*b*. Accordingly, since both the intermediate heat exchanger 15*a* and the intermediate heat exchanger 15*b* can be used for a heating operation or a cooling operation, a large heat transmission area can be achieved, thus an efficient heating operation or cooling operation is ensured.

Furthermore, in the case where heating load and cooling load are generated in a mixed manner in the use-side heat exchangers 26, a heating operation and a cooling operation can be freely performed in each of the indoor units 2 by switching a first heat medium flow switching device 22 and a second heat medium flow switching device 23 corresponding to a use-side heat exchanger 26 that is performing a heating operation to the flow connected to the intermediate heat exchanger 15*b* for heating and switching a first heat medium flow switching device 22 and a second heat medium flow switching device 23 corresponding to a use-side heat exchanger 26 that is performing a cooling operation to the flow connected to the intermediate heat exchanger 15*a* for cooling.

Furthermore, the medium pressure detection device 32 may calculate medium pressure, for example, by a calculation by the controller 50 on the basis of temperature detected by a temperature sensor, as well as by a pressure sensor. Furthermore, in the case where an electronic expansion valve or the like whose opening area can be changed is used as the expansion device 14*b*, the controller 50 controls the opening area of the expansion device 14*b* such that the discharge temperature of the compressor 10 detected by the discharged refrigerant temperature detection device 37 does not become excessively high. Regarding a way how to perform control, when it is determined that the discharge temperature exceeds a specific value (for example, 110 degrees Centigrade or the like), the opening degree of the expansion device 14*b* may be controlled to be opened by a specific opening degree, for example, by 10 pulses.

Furthermore, the opening degree of the expansion device 14*b* may be controlled such that the discharge temperature is maintained at a target value (for example, 100 degrees Centigrade). Alternatively, the opening degree of the expansion device 14*b* may be controlled such that the discharge temperature falls within a target range (for example, between 90 degrees Centigrade and 100 degrees Centigrade). Furthermore, by calculating the discharge degree of superheat of the compressor 10 on the basis of the temperature detected by the discharged refrigerant temperature detection device 37 and the pressure detected by the high-pressure detection device 39, the opening degree of the expansion device 14*b* may be controlled such that the discharge degree of superheat is maintained at a target value (for example, 40 degrees Centigrade) or such that the discharge degree of superheat falls within a target range (for example, between 20 degrees Centigrade and 40 degrees Centigrade).

Although the first heat medium flow switching devices 22 and the second heat medium flow switching devices 23 explained in Embodiment 1 may be devices that can perform switching of a flow passage, such as a combination of two devices, that is, a three-way valve or the like that can perform switching between three-way passages and an opening/closing valve or the like that opens and closes two-way passages. Furthermore, two devices, that is, a combination of a mixing valve of a stepping motor driven type or the like that can change the flow rate of three-way passages and an electronic expansion valve or the like that can change the flow rate of two-way passages, may be used as the first heat medium flow switching devices 22 and the second heat medium flow switching devices 23. In this case, occurrence of water hammering, which is caused by sudden opening/closing of a flow passage, can be prevented. Furthermore, although the case in which the heat medium flow control devices 25 are two-way valves has been described as an example in Embodiment 1, control valves having three-way passages may be provided as the heat medium flow control devices 25, together with bypass pipes for bypassing the use-side heat exchangers 26.

Furthermore, devices of a stepping motor driven type that can control the flow rate in a flow passage preferably be used as the heat medium flow control devices 25. Two-way valves, three-way vales whose one end is closed, or the like may be used as the heat medium flow control devices 25. Furthermore, opening/closing valves or the like that open and close two-way passages may be used as the heat medium flow control devices 25, so that the average flow rate can be controlled by repeating ON and OFF.

Furthermore, although the second refrigerant flow switching devices 18 have been explained as if they were four-way valves, the second refrigerant flow switching devices 18 are not necessarily four-way valves. The second refrigerant flow switching devices 18 may be configured to include a plurality of two-way flow switching valves or three-way flow switching valves so that the refrigerant flows in a way similar to that described above.

Furthermore, needless to mention, a similar operation can be achieved even in the case where only one use-side heat exchanger 26 and one heat medium flow control device 25 are connected. In addition, naturally, there is no problem if a plurality of devices that perform the same operations are provided as the intermediate heat exchangers 15 and the expansion devices 16. Moreover, although the case in which the heat medium flow control devices 25 are built in the heat medium relay unit 3 has been described above as an example, the heat medium flow control devices 25 are not necessarily built in the heat medium relay unit 3 and may be built in the indoor units 2. Alternatively, the heat medium flow control devices 25 may be configured independent of the heat medium relay unit 3 and the indoor units 2.

As a heat medium, for example, brine (antifreeze), water, a liquid mixture of brine and water, a liquid mixture of water and an additive having a high anticorrosive effect, or the like may be used. Thus, in the air-conditioning apparatus 100, even if the heat medium leaks through the indoor units 2 to the indoor space 7, since a material used for the heat medium is highly safe, the use of the highly safe material contributes to improvement in the safety.

Furthermore, in general, a fan is mounted in each of the heat-source-side heat exchanger 12 and the use-side heat exchangers 26*a* to 26*d* in many cases, so that condensation or evaporation is urged by air sending. However, a fan is not necessarily mounted in each of the heat-source-side heat exchanger 12 and the use-side heat exchangers 26*a* to 26*d*. For example, panel heaters or the like that use radiation may be used as the use-side heat exchangers 26*a* to 26*d*, and a device of a water cooled type that transports heat by water or antifreeze may be used as the heat-source-side heat exchanger 12. That is, devices of any type may be used as the heat-source-side heat exchanger 12 and the use-side heat exchangers 26*a* to 26*d* as long as they have a configuration capable of transferring or receiving heat.

In Embodiment 1, the case where four use-side heat exchangers, the use-side heat exchangers 26*a* to 26*d*, are provided has been explained as an example. However, any number of use-side heat exchangers may be connected. Furthermore, the case where two intermediate heat exchangers, the intermediate heat exchanger 15*a* and the intermediate heat exchanger 15*b*, are provided has been explained as an example. However, obviously, the configuration is not limited thereto and any number of intermediate heat exchangers can be provided as long as they are configured to be capable of cooling and/or heating the heat medium. Furthermore, the number of each of the pump 21*a* and the pump 21*b* is not necessarily one. A plurality of small-capacity pumps may be arranged in parallel to one another. Furthermore, although the case in which the air-conditioning apparatus 100 includes the accumulator 19 has been explained as an example in Embodiment 1, the accumulator 19 is not necessarily provided.

Normal gas-liquid separators separate a gas refrigerant and a liquid refrigerant in a two-phase refrigerant from each other. In contrast, as explained above, in the case of the gas-liquid separators 27 (the gas-liquid separator 27*a* and the gas-liquid separator 27*b*) used in the air-conditioning apparatus 100, when the refrigerant in the two-phase state flows into the inlet of the gas-liquid separators 27, the gas-liquid separators 27 separate part of a liquid refrigerant from the two-phase refrigerant, run the separated part of liquid refrigerant through the branch pipe 4*d*, and cause the residual two-phase refrigerant (having a slightly increased quality) to flow out of the gas-liquid separators 27. Thus, as shown in FIG. 2 or the like, it is preferable that horizontal gas-liquid separators having a structure in which an inlet pipe and an outlet pipe are arranged on lateral sides (left and right sides) of the gas-liquid separators and an extraction pipe for a liquid refrigerant (branch pipe 4*d*) allows the separated liquid refrigerant to flow toward a lower portion of the gas-liquid separators (a portion lower than the center in the height direction of the gas-liquid separators 27) are used as the gas-liquid separators 27.

A horizontal gas-liquid separator represents a gas-liquid separator having a structure in which when the gas-liquid separator is arranged, the length in the horizontal direction, which is a direction in which the refrigerant flows in and flows out is greater than the length in the vertical direction, which is perpendicular to the direction in which the refrigerant flows in (the horizontal direction in which the refrigerant flows in). However, as the gas-liquid separators 27, any structure may be adoptable as long as part of a liquid refrigerant can be separated from the refrigerant that has flowed in the gas-liquid separators 27 in the two-phase state and the residual two-phase refrigerant can be flowed out of the gas-liquid separators 27.

Furthermore, the system has been explained as an example in which the compressor 10, the first refrigerant flow switching device 11, the heat-source-side heat exchanger 12, the expansion device 14*a*, the expansion device 14*b*, the opening/closing device (or first conduction device) 24, and the backflow prevention device (or second conduction device) 20 are accommodated within the outdoor unit 1, the use-side heat exchangers 26 are accommodated within the indoor units 2, and the intermediate heat exchangers 15 and the expansion devices 16 are accommodated within the heat medium relay unit 3. The system has been further explained as an example in which a pair of pipes connects the outdoor unit 1 with the heat medium relay unit 3, so that the heat medium circulates between the outdoor unit 1 and the heat medium relay unit 3, a pair of pipes connects each of the indoor units 2 with the heat medium relay unit 3, so that the heat medium circulates between the indoor unit 2 and the heat medium relay unit 3, and the intermediate heat exchangers 15 perform heat exchange between the refrigerant and the heat medium. However, the system does not necessarily have the above-mentioned configuration.

For example, application to a direct expansion system is also possible in which the compressor 10, the first refrigerant flow switching device 11, the heat-source-side heat exchanger 12, the expansion device 14*a*, the expansion device 14*b*, the opening/closing device 24, and the backflow prevention device 20 are accommodated within the outdoor unit 1, load-side heat exchangers that perform heat exchange between air in an air-conditioned space and the refrigerant and the expansion devices 16 are accommodated within the indoor units 2, a relay unit formed independent of the outdoor unit 1 and the indoor units 2 is provided, a pair of pipes connects the outdoor unit 1 with the relay unit, a pair of pipes connects each of the indoor units 2 with the relay unit, the refrigerant is caused to circulate between the outdoor unit 1 and each of the indoor units 2 via the relay unit, and a cooling only operation, a heating only operation, a cooling main operation, and a heating main operation can be performed. With this system, similar effects can be achieved.

Furthermore, application to an air-conditioning apparatus of a direct expansion type is also possible in which the compressor 10, the first refrigerant flow switching device 11, the heat-source-side heat exchanger 12, the expansion device 14*a*, and the expansion device 14*b* are accommodated within the outdoor unit 1, load-side heat exchangers that perform heat exchange between air in an air-conditioned space and the refrigerant and the expansion devices 16 are accommodated within the indoor units 2, a pair of pipes connects each of a plurality of indoor units to the outdoor unit 1, so that the refrigerant circulates between the outdoor unit 1 and the indoor units 2, and only switching between a cooling only operation and a heating only operation is performed. With this system, similar effects can also be achieved.

Furthermore, application to an air-conditioning apparatus is also possible in which a heat exchanger that exchanges heat between water and the refrigerant is provided in the heat medium relay unit 3 and only switching between a cooling only operation and a heating only operation is performed. With this system, similar effects can also be achieved.

As described above, the air-conditioning apparatus 100 according to Embodiment 1 can perform suction-injection of the refrigerant to the suction side of the compressor 10 so that the discharge temperature is controlled not to become excessively high, regardless of an operation mode, even in the case where a refrigerant, such as R32, the use of which increases the discharge temperature of the compressor 10, is used. Therefore, with the air-conditioning apparatus 100, the refrigerant and refrigerating machine oil can be efficiently suppressed from being deteriorated, and a safe operation can be achieved, thus a longer service life is ensured.

Embodiment 2

Figure 14:
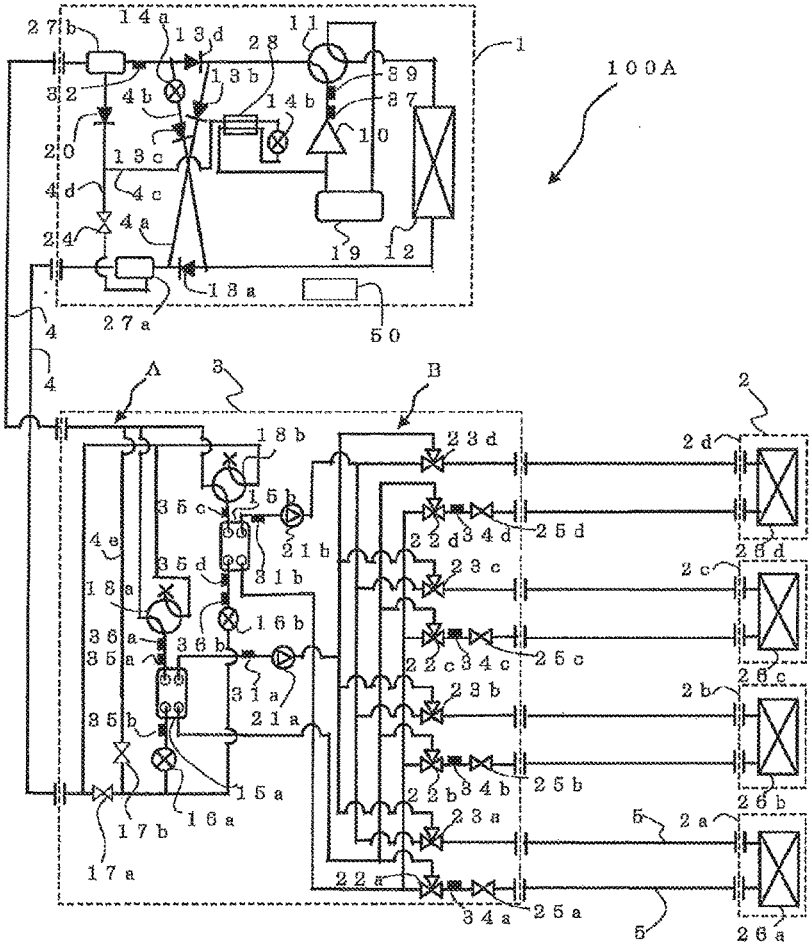
FIG. 14 is a schematic circuit configuration diagram illustrating an example of the circuit configuration of an air-conditioning apparatus according to Embodiment 2 of the present invention.

FIG. 14 is a schematic circuit configuration diagram illustrating an example of the circuit configuration of an air-conditioning apparatus (hereinafter, referred to as an air-conditioning apparatus 100A) according to Embodiment 2. The air-conditioning apparatus 100A will be explained with reference to FIG. 14. In Embodiment 2, differences from Embodiment 1 described above will be mainly explained, and explanation for the same portions as those in Embodiment 1, such as the refrigerant circuit configuration, will be omitted. Furthermore, since operation modes executed by the air-conditioning apparatus 100A are similar to those executed by the air-conditioning apparatus 100 according to Embodiment 1, explanation for the operation modes will also be omitted.

As illustrated in FIG. 14, in the air-conditioning apparatus 100A, a refrigerant-refrigerant heat exchanger 28 is mounted at the suction-injection pipe 4*c* connected to the suction side of the compressor 10. A liquid refrigerant separated by the gas-liquid separator 27*a* and the gas-liquid separator 27*b* flows into the expansion device 14*a* and the expansion device 14*b*. However, the liquid refrigerant separated by the gas-liquid separator 27*a* and the gas-liquid separator 27*b* is not sub-cooled in any mode except for a cooling only operation mode and are in the saturated liquid state.

In actuality, saturated liquid is in a state in which a small amount of minute refrigerant gas exists, and may turn into the two-phase refrigerant due to minute pressure loss in the opening/closing device 24, a refrigerant pipe, or the like. With the use of an electronic expansion valve as an expansion device, when the refrigerant in the two-phase state flows into the expansion device, in the case where a gas refrigerant and a liquid refrigerant flow separately, a state in which gas flows in the expansion part and a state in which liquid flows in the expansion part occur independently. Therefore, the pressure at the exit side of the expansion device may be unstable. In particular, in the case where the quality is low, refrigerant separation occurs, and this tendency is highly likely to occur.

Under such circumstances, in the air-conditioning apparatus 100A according to Embodiment 2, the refrigerant-refrigerant heat exchanger 28 is mounted at the suction-injection pipe 4*c*. The refrigerant-refrigerant heat exchanger 28 exchanges heat between a high-pressure liquid refrigerant separated by the gas-liquid separator 27*a* or the gas-liquid separator 27*b* and a two-phase, low-pressure refrigerant decompressed by the expansion device 14*b*. By this processing, a high-pressure liquid refrigerant flowing into the refrigerant-refrigerant heat exchanger 28 is decompressed and cooled by a two-phase, low-pressure refrigerant whose pressure and temperature have been reduced, and thus the liquid refrigerant is sub-cooled and flows into the expansion device 14*b*. Therefore, the refrigerant containing bubbles is prevented from flowing into the expansion device 14*b*, and a stable control can be ensured in all the cooling only operation, heating only operation, cooling main operation, and heating main operation.

As described above, the air-conditioning apparatus 100A according to Embodiment 2 achieves effects similar to those of the air-conditioning apparatus 100 according to Embodiment 1, and is capable of controlling individual executed operation modes more stably.

The invention claimed is:

1. An air-conditioning apparatus having a refrigeration cycle including a compressor, a first heat exchanger, a first expansion device, and a plurality of second heat exchangers that are connected by pipes, the air-conditioning apparatus comprising:

a suction-injection pipe configured to introduce, into a suction side of the compressor, injection refrigerant that is drawn from a refrigerant flow passage through which refrigerant that transfers heat in the first heat exchanger or the second heat exchangers circulates, wherein the injection refrigerant is in a liquid or a two-phase state;

a second expansion device arranged at the suction-injection pipe;

a controller configured to regulate, by controlling an opening degree of the second expansion device, a suction-injection flow rate of the injection refrigerant into the suction side of the compressor through the suction-injection pipe;

a first branching unit configured to draw refrigerant from the refrigerant flow passage in a case in which the refrigerant flows from the first heat exchanger to the first expansion device;

a second branching unit configured to draw refrigerant from the refrigerant flow passage in a case in which the refrigerant flows from the first expansion device to the first heat exchanger;

a branch pipe configured to connect the first branching unit with the second branching unit, wherein the branch pipe is connected to the suction-injection pipe at a connection portion;

a first conduction device arranged between the first branching unit and the connection portion; and a second conduction device arranged between the second branching unit and the connection portion.

2. The air-conditioning apparatus of claim 1, further comprising:

a refrigerant flow switching device configured to perform switching of the refrigerant flow passage, depending on whether a high-pressure refrigerant flows in the first heat exchanger, in which case the first heat exchanger functions as a condenser, or a low-pressure refrigerant flows in the first heat exchanger, in which case the first heat exchanger functions as an evaporator; and a third expansion device configured to generate, in the case in which the first heat exchanger functions as an evaporator, a medium pressure refrigerant, a pressure of which is lower than a relatively high pressure refrigerant that is inside the second heat exchangers in a case in which the second heat exchangers function as condensers and that is higher than a relatively low pressure refrigerant that is inside the first heat exchanger in the case in which the first heat exchanger functions as the evaporator, wherein the controller allows, in the case in which the first heat exchanger functions as a condenser, relatively high-pressure refrigerant to flow through the suction-injection pipe, and allows, in the case in which the first heat exchanger functions as an evaporator, the medium pressure refrigerant generated by the third expansion device to flow through the suction-injection pipe.

3. The air-conditioning apparatus of claim 2, wherein, in the case in which the first heat exchanger functions as a condenser, refrigerant is caused to circulate between the first heat exchanger and the second heat exchangers without causing the refrigerant to pass through the third expansion device, and wherein, in the case in which the first heat exchanger functions as an evaporator, the refrigerant is caused to pass through the second heat exchangers and then the third expansion device and then to flow into the first heat exchanger.

4. The air-conditioning apparatus of claim 2, wherein the third expansion device includes, at a portion of a flow passage that is on an entry side of an expansion part and that is adjacent to the expansion part, a mixing device configured to mix a two-phase gas-liquid refrigerant that has flowed into the third expansion device.

5. The air-conditioning apparatus of claim 1, wherein the first conduction device is an opening/closing device configured to open and close the refrigerant flow passage of the branch pipe, and the second conduction device is a backflow prevention device configured to flow a refrigerant only in a direction from the second branching unit to the suction-injection pipe.

6. The air-conditioning apparatus of claim 1, wherein the first branching unit is a gas-liquid separator configured to deliver refrigerant that is mainly in a liquid state to the branch pipe.

7. The air-conditioning apparatus of claim 6, wherein the gas-liquid separator has a structure in which a length in an in-flow direction, in which the refrigerant flows into the gas-liquid separator, is greater than a length in a direction perpendicular to the in-flow direction, an inlet pipe, from which refrigerant flows into the gas-liquid separator, and an outlet pipe, through which a majority of the refrigerant flows out of the gas-liquid separator, extend in a direction in which the refrigerant flows into the gas-liquid separator, and the branch pipe is connected to a lower portion of the gas-liquid separator that is lower than a central portion in a height direction of the gas-liquid separator, and the branch pipe is configured to extract part of the refrigerant in the liquid state from inside of the gas-liquid separator to outside of the gas-liquid separator.

8. The air-conditioning apparatus of claim 1, wherein the second branching unit is a gas-liquid separator configured to deliver refrigerant that is mainly in a liquid state to the branch pipe.

9. The air-conditioning apparatus of claim 1, further comprising a discharged refrigerant temperature detection device for detecting temperature of refrigerant discharged from the compressor, wherein the controller regulates an opening area of the second expansion device in such a manner that the temperature of the discharged refrigerant detected by the discharged refrigerant temperature detection device becomes closer to a target temperature, does not exceed the target temperature, or falls within a target temperature range.

10. The air-conditioning apparatus of claim 1, further comprising:

a discharged refrigerant temperature detection device for detecting temperature of a refrigerant discharged from the compressor; and a high-pressure detection device for detecting pressure of the refrigerant discharged from the compressor, wherein the controller regulates an opening area of the second expansion device in such a manner that a discharge degree of superheat calculated from the temperature of the discharged refrigerant detected by the discharged refrigerant temperature detection device and the refrigerant pressure detected by the high-pressure detection device becomes closer to a target degree of superheat, does not exceed the target degree of superheat, or falls within a target degree range of superheat.

11. The air-conditioning apparatus of claim 1, further comprising a medium pressure detection device for detecting medium pressure or saturation temperature at the medium pressure, the medium pressure detection device being arranged at the refrigerant flow passage between the second branching unit and the third expansion device, wherein, in a state in which the first heat exchanger functions as an evaporator, the controller regulates an opening area of the third expansion device in such a manner that the medium pressure or the saturation temperature at the medium pressure detected by the medium pressure detection device becomes closer to a target value or falls within a target range.

12. The air-conditioning apparatus of claim 1, wherein a refrigerant-refrigerant heat exchanger is arranged at a portion of the suction-injection pipe that is positioned between the connection portion of the branch pipe and the suction-injection pipe and the second expansion device, and the refrigerant-refrigerant heat exchanger exchanges heat between the refrigerant that has flowed in from the connection portion and the refrigerant that has flowed out of the second expansion device.

13. The air-conditioning apparatus of claim 1, wherein the second expansion device includes, at a portion of a flow passage that is on an entry side of an expansion part and that is adjacent to the expansion part, a mixing device configured to mix a two-phase gas-liquid refrigerant that has flowed into the second expansion device.

14. The air-conditioning apparatus of claim 1, further comprising:

an outdoor unit accommodating the compressor, the refrigerant flow switching device, the first heat exchanger, the second expansion device, the suction-injection pipe, the branch pipe, the first branching unit, the second branching unit, the first conduction device means, and the second conduction device;

an indoor unit accommodating a use-side heat exchanger configured to exchange heat with air in an air-conditioned space and arranged at a position from which the air-conditioned space can be air-conditioned; and a heat medium relay unit accommodating the second heat exchangers and the first expansion device, the heat medium relay unit being configured independently of the outdoor unit and the indoor unit, wherein two refrigerant pipes through which refrigerant circulates connect between the outdoor unit and the heat medium relay unit, two heat medium pipes through which a heat medium circulates connect between the heat medium relay unit and the indoor unit, the second heat exchangers exchange heat between the refrigerant and the heat medium, and the use-side heat exchanger exchanges heat between the air in the air-conditioned space and the heat medium.

15. The air-conditioning apparatus of claim 14, wherein the controller is capable of selectively executing a cooling only operation mode, in which the first heat exchanger operates as a condenser, all of the second heat exchangers operate as an evaporator, a high-pressure liquid refrigerant flows in one of the two refrigerant pipes, and a low-pressure gas refrigerant flows in the other one of the two refrigerant pipes, and a heating only operation mode, in which the first heat exchanger operates as an evaporator, all of the second heat exchangers operate as a condenser, a high-pressure gas refrigerant flows in one of the two refrigerant pipes, and a medium pressure, two-phase gas-liquid refrigerant or a medium pressure liquid refrigerant flows in the other one of the two refrigerant pipes.

16. The air-conditioning apparatus of claim 14, wherein the controller is capable of selectively executing a cooling main operation mode, in which the first heat exchanger operates as a condenser, part of the second heat exchangers operate as an evaporator, the rest of the second heat exchangers operate as a condenser, a high-pressure, two-phase gas-liquid refrigerant flows in one of the two refrigerant pipes, and a low-pressure gas refrigerant flows in the other one of the two refrigerant pipes, and a heating main operation mode, in which the first heat exchanger operates as an evaporator, part of the second heat exchangers operate as a condenser, the rest of the second heat exchangers operate as an evaporator, a high-pressure gas refrigerant flows in one of the two refrigerant pipes, and a medium pressure, two-phase gas-liquid refrigerant flows in the other one of the two refrigerant pipes.

17. The air-conditioning apparatus of claim 1, further comprising:

an outdoor unit accommodating the compressor, the refrigerant flow switching device, the first heat exchanger, the second expansion device, the suction-injection pipe, the branch pipe, the first branching unit, the second branching unit, the first conduction device means, and the second conduction device means;

an indoor unit accommodating the second heat exchanger and the first expansion device and arranged at a position from which an air-conditioned space can be air-conditioned; and a relay unit configured to be independent of the outdoor unit and the indoor unit, wherein two refrigerant pipes connect between the outdoor unit and the relay unit and between the relay unit and the indoor unit, wherein the refrigerant circulates, via the relay unit, between the outdoor unit and the indoor unit, and wherein the second heat exchanger exchanges heat between the refrigerant and the air in the air-conditioned space.

18. The air-conditioning apparatus of claim 1, wherein a refrigerant used in the refrigeration cycle is R32, a mixed refrigerant containing R32 having a mass ratio of 62% or higher and HFO1234yf, or a mixed refrigerant containing R32 having a mass ratio of 43% or higher and HFO1234ze.

* * * * *